US008375686B2

(12) United States Patent
Caudle et al.

(10) Patent No.: US 8,375,686 B2
(45) Date of Patent: Feb. 19, 2013

(54) ASEPTIC PACKAGING SYSTEM, PACKAGING PROCESS AND PACKAGE WITH EXTERNAL FITMENT

(75) Inventors: Timothy G. Caudle, Simpsonville, SC (US); Kenneth Micnerski, Grayslake, IL (US)

(73) Assignee: Cryovac, Inc., Duncan, SC (US)

( * ) Notice: Subject to any disclaimer, the term of this patent is extended or adjusted under 35 U.S.C. 154(b) by 389 days.

(21) Appl. No.: 12/653,991

(22) Filed: Dec. 22, 2009

(65) Prior Publication Data

US 2011/0146204 A1 Jun. 23, 2011

(51) Int. Cl.
*B65B 55/04* (2006.01)

(52) U.S. Cl. ..... 53/426; 53/451; 53/551; 53/133.1

(58) Field of Classification Search ..... 53/425, 53/426, 451, 477, 550, 551, 552, 133.1, 389.2
See application file for complete search history.

(56) References Cited

U.S. PATENT DOCUMENTS

| | | | | |
|---|---|---|---|---|
| 3,246,444 | A * | 4/1966 | Paisley | 53/412 |
| 3,894,381 | A * | 7/1975 | Christine et al. | 53/133.2 |
| 4,366,125 | A * | 12/1982 | Kodera et al. | 422/295 |
| 4,440,316 | A | 4/1984 | Christine | |
| 4,445,550 | A | 5/1984 | Davis et al. | |
| 4,516,691 | A | 5/1985 | Christine et al. | |
| 4,603,793 | A | 8/1986 | Stern | |
| 4,656,813 | A * | 4/1987 | Baldini et al. | 53/410 |
| 4,709,528 | A * | 12/1987 | Merkus | 53/133.2 |
| 4,779,397 | A | 10/1988 | Christine et al. | |
| 5,467,581 | A | 11/1995 | Everette | |
| 5,645,913 | A | 7/1997 | Rogers | |
| 5,915,596 | A * | 6/1999 | Credle, Jr. | 222/105 |
| 6,244,747 | B1 | 6/2001 | Caudle | |
| 6,751,934 | B2 * | 6/2004 | Focke et al. | 53/444 |
| 6,779,318 | B2 * | 8/2004 | Wang | 53/410 |

(Continued)

FOREIGN PATENT DOCUMENTS

WO 9505317 A1 2/1995

OTHER PUBLICATIONS

"A breakthrough in 'Aseptic Spouted Pouches' (ASP)", Aseptipak 2009, Chicago, Oct. 27, 2009, 22 pages.

(Continued)

*Primary Examiner* — Paul R Durand
(74) *Attorney, Agent, or Firm* — Mark B. Quatt

(57) ABSTRACT

An aseptic packaging system includes a film unwind device; a fitment feed device for feeding a plurality of fitments; an apparatus for attaching each of the fitments to a second surface of the film; an assembly for sterilizing the film and optionally each of the fitments; an assembly for drying the film and optionally each of the fitments; and a vertical form/fill seal apparatus for making packages from the sterilized film and each of the fitments, each package comprising a pouch comprising a first and second transverse seal, a first and second fold, an interior and exterior surface, and a longitudinal seal; and an external fitment sealed to the exterior surface of the pouch; and a sterilized product disposed in the pouch. An aseptic process and package are also disclosed.

15 Claims, 15 Drawing Sheets

U.S. PATENT DOCUMENTS

| | | | | |
|---|---|---|---|---|
| 6,860,407 | B2 * | 3/2005 | Gosselin | 222/105 |
| 7,086,570 | B2 | 8/2006 | Canegallo | |
| 7,284,303 | B2 | 10/2007 | Canegallo | |
| 7,357,276 | B2 | 4/2008 | Savage et al. | |
| 7,594,372 | B2 | 9/2009 | Micnerski | |
| 2001/0015054 | A1 | 8/2001 | Caudle | |
| 2001/0017022 | A1 | 8/2001 | Siccardi | |
| 2002/0158100 | A1 | 10/2002 | Schmidt | |
| 2003/0177739 | A1 | 9/2003 | Lewis, Jr. et al. | |
| 2004/0123883 | A1 * | 7/2004 | Pritchard et al. | 134/63 |
| 2004/0134165 | A1 | 7/2004 | Basque et al. | |
| 2005/0178798 | A1 | 8/2005 | Canegallo | |
| 2005/0252176 | A1 | 11/2005 | Pritchard | |
| 2006/0111224 | A1 | 5/2006 | Caudle | |
| 2006/0228502 | A1 | 10/2006 | Bekele | |
| 2007/0025648 | A1 | 2/2007 | Micnerski et al. | |
| 2007/0110853 | A1 | 5/2007 | Bekele | |
| 2007/0217718 | A1 | 9/2007 | Micnerski et al. | |
| 2008/0029540 | A1 | 2/2008 | Johnson | |
| 2008/0090062 | A1 | 4/2008 | Breck et al. | |
| 2009/0123611 | A1 | 5/2009 | Bekele | |
| 2009/0308023 | A1 * | 12/2009 | Wada | 53/133.2 |

OTHER PUBLICATIONS

"Food firms tap into aseptic", Kevin T. Higgins, Sep. 28, 2005, 6 pages.
"Introduction", FSRE Shelf-Stable, May 11, 2005, 4 pages.
"DuPont Liquid Packaging Systems/Liqui-Box™/Aseptic Bulk Packaging", prior to Dec. 22, 2009, 1 page.
"DuPont Liquid Packaging Systems/Liqui-Box™/StarAsept™ UniSeal fitment", 2006, 2 pages.
"DuPont Liquid Packaging Systems/Liqui-Box™/DuPont™ Q-Connect™", 2006, 2 pages.
"DuPont Liquid Packaging Systems Home Page", Nov. 13, 2009, 2 pages.
"Aseptic Processing", Wikipedia, Nov. 13, 2009, 2 pages.
"Guide to Inspections of Aseptic Processing and Packaging for the Food Industry", Feb. 2001, 22 pages.

* cited by examiner

ASEPTIC PACKAGING SYSTEM, PACKAGING PROCESS AND PACKAGE WITH EXTERNAL FITMENT

FIELD OF THE INVENTION

This invention relates to an aseptic packaging system, packaging process, and package in which the package includes an external fitment.

BACKGROUND OF THE INVENTION

Aseptic food packaging is a well known method of packaging a food product. Aseptic packaging requires special treatment and handling of the food product as well as all of the equipment that contacts the food product until it is secured inside of a hermetic container. This method includes the destruction of all molds, yeasts and pathogens of concern for the specific food product. In the US, the FDA has jurisdiction over all food packaged in the Low Acid range (4.4 pH and higher) white food packaged in the High Acid (4.4 pH and lower) range is confirmed by the food processor utilizing that technology. Common methods employed in attaining this commercial sterility include steam, heated air, and chemicals. Sometimes the term Commercially Sterile is simply referred to as sterile. It is thus known to produce sterilized packaging in which a sterile food product is placed in a sterilized container such as a pouch. The food product is thus preserved for later storage or use. Various methods of sterilizing the container or material used to make the container, and filling the container with a sterilized product, are known. Hydrogen peroxide is a common medium for sterilization of the packaging material.

In general, in the field of packaging food and non-food liquid and/or flowable and/or pumpable food and non-food products, a convenient method of packaging such products in thermoplastic film has been developed and is generally known as a vertical form/fill/seal process. In such a process a tube is typically formed from a laminate including e.g. various nylons, PET and foil, or a coextruded multi-layer thermoplastic film, a longitudinal fin or lap seal is made, and an end seal is made by transversely sealing across the tube with heated seal bars to form a conveniently wide heat seal and, consequently, producing a pouch ready to receive a product. The seal can be made by any of various sealing methods known to those of skill in the art, including heat sealing, ultrasonic sealing, impulse sealing, constant heat sealing, radio frequency sealing, and the like. After the seal, e.g. a heat seal is made, the bag or pouch is filled and then another transverse heat seal is made across the width of the tube in a relatively wide band. After cooling, this seal is transversely severed to separate the filled bag from the next pouch to be filled. Thus, one wide band seal serves as the bottom seal for one pouch and the top seal for another.

Many vertical form/fill/seal systems are commercially available from manufacturers or suppliers such as Hayssen, Illipak, Kartridge Pak, DuPont and Fresco.

Vertical form/fill/seal (VFFS) packaging systems have proven to be very useful in packaging a wide variety of food and non-food pumpable and/or flowable products. An example of such systems is the ONPACK™ flowable food packaging system marketed by Cryovac/Sealed Air Corporation. The VFFS process is known to those of skill in the art, and described for example in U.S. Pat. No. 4,506,494 (Shimoyama et al.), U.S. Pat. No. 4,589,247 (Tsuruta et al), U.S. Pat. No. 4,656,818 (Shimoyama et al.), U.S. Pat. No. 4,768,411 (Su), U.S. Pat. No. 4,808,010 (Vogan), and U.S. Pat. No. 5,467,581 (Everette), all incorporated herein by reference in their entirety. Typically in such a process, lay-flat thermoplastic film is advanced over a forming device to form a tube, a longitudinal (vertical) fin or lap seal is made, and a bottom end seal is made by transversely sealing across the tube with heated seal bars. A liquid, flowable, and/or pumpable product, such as a liquid, semiliquid, or paste, with or without particulates therein, is introduced through a central, vertical fill tube to the formed tubular film. Squeeze rollers spaced apart and above the bottom end seal squeeze the filled tube and pinch the walls of the flattened tube together. When a length of tubing of the desired height of the bag has been fed through the squeeze rollers a heat seal is made transversely across the flattened tubing by heat seal bars which clamp and seal the film of the tube therebetween. After the seal bars have been withdrawn the film moves downwardly to be contacted by cooled clamping and severing bars which clamp the film therebetween and are provided with a cutting knife to sever the sealed film at about the midpoint of the seal so that approximately half of the seal will be on the upper part of a tube and the other half on the lower. When the sealing and severing operation is complete, the squeeze rollers are separated to allow a new charge of product to enter the flattened tube after which the aforementioned described process is repeated thus continuously producing vertical form/fill/seal pouches which have a bottom end and top end heat seal closure.

The process can be a two-stage process where the creation of a transverse heat seal occurs at one stage in the process, and then, downstream of the first stage, a separate pair of cooling/clamping means contact the just-formed transverse heat seal to cool and thus strengthen the seal. In some VFFS processes, an upper transverse seal of a first pouch, and the lower transverse seal of a following pouch, are made, and the pouches are cut and thereby separated between two portions of the transverse seals, without the need for a separate step to clamp, cool, and cut the seals. A commercial example of an apparatus embodying this more simplified process is the ONPACK™ 2002 VFFS packaging machine marketed by Cryovac/Sealed Air Corporation.

U.S. Pat. No. 4,603,793 (Stern), incorporated herein by reference in its entirety, discloses a coupling means or fitment 6a which is mounted on the inside wall of a pouch, and is capable of connecting to a pumping device to permits the contents of the pouch to be dispensed in a controllable way.

Packaging systems combining the ONPACK™ system with the fitment technology of U.S. Pat. No. 4,603,793 provide a pouch making system where the pouch, containing a food product, includes an internal fitment.

SUMMARY OF THE INVENTION

Statement of Invention/Embodiments of the Invention

In a first aspect, an aseptic packaging system comprises:

a film unwind device for unwinding a film from a first roll of film;

a fitment feed device for feeding a plurality of fitments;

an apparatus for attaching each of the plurality of fitments to the film;

an assembly for sterilizing the film and each of the plurality of fitments;

an assembly for drying the film and each of the plurality of fitments; and a vertical form/fill seal apparatus for making a plurality of packages from the sterilized film and each of the plurality of sterilized fitments, each package comprising a pouch comprising a first transverse seal at a first end of the pouch, a second transverse seal at a second end of the pouch, a first fold at a first side of the pouch, a second fold at a second side of the pouch, an interior surface, an exterior surface, a longitudinal seal extending from the first end of the pouch to the second end of the pouch; and an external fitment sealed to the exterior surface of the pouch; and a sterilized product disposed in the pouch.

Optionally, according to various embodiments of the first aspect of the invention, separately and independently listed hereunder:

1) the system comprises a second roll of film, a second end of the first roll of film capable of being spliced to a first end of the second roll of film.

2) the fitment feed device for feeding a plurality of fitments comprises an orienter for aligning the plurality of fitments in a pre-determined direction, and a guiding device for guiding each of the plurality of fitments to the apparatus for attaching each of the plurality of fitments to the film.

3) the fitment feed device for feeding a plurality of fitments comprises an orienter for aligning the plurality of fitments in a pre-determined direction, and a guiding device for guiding each of the plurality of fitments to the apparatus for attaching each of the plurality of fitments to the film in sequential fashion.

4) each of the plurality of fitments comprises an annular ring, and a central orifice.

5) each of the plurality of fitments comprises an annular ring, a central orifice, and an annular depression disposed on the inner surface of the annular ring.

6) the apparatus for attaching each of the plurality of fitments to the film comprises an apparatus for partially attaching each of the plurality of fitments to the film, and the vertical form/fill/seal apparatus comprises a device for completing the attachment of each of the plurality of fitments to the film.

7) the apparatus for partially attaching each of the plurality of fitments to the film, according to embodiment 6) above, comprises a sealing assembly wherein a seal bar seals the film to only a portion of the fitment at two regions on the fitment, the two regions spaced apart from one another.

8) the apparatus for partially attaching each of the plurality of fitments to the film, according to embodiment 6) above, comprises a sealing system wherein each of the plurality of fitments comprises an annular ring, and a central orifice, and a seal bar seals the film to only a portion of the annular ring, at two regions on the annular ring, the two regions spaced apart from one another.

9) the apparatus for partially attaching each of the plurality of fitments to the film, according to embodiment 6) above, comprises a sealing system wherein each of the plurality of fitments comprises an annular ring, and a central orifice, and a seal bar seals the film to only a portion of the annular ring, at two regions on the annular ring, the two regions spaced apart from one another by about 180°.

10) the assembly for sterilizing the film and each of the plurality of fitments comprises a hydrogen peroxide bath.

11) the assembly for drying the film and each of the plurality of fitments comprises a drying chamber, wherein the drying chamber includes a tubular device for projecting sterile air onto each of the plurality of fitments as each fitment advances through the drying chamber.

12) the assembly for drying the film and each of the plurality of fitments, according to embodiment 6) above, comprises a fixed mandrel disposed opposite each fitment, that deflects the film as each fitment advances through the drying chamber, resulting in diversion of the film away from unattached portions of each fitment to facilitate drying of each fitment.

13) the device for completing the attachment of each of the plurality of fitments to the film, according to embodiment 6) above, comprises a sealing assembly wherein a seal bar completes the attachment of each of the partially attached plurality of fitments to the second surface of the film.

14) each package is absent an internal fitment.

15) each package is absent an internal fitment in the vicinity of the external fitment.

The invention in accordance with the first aspect of the invention optionally encompasses any suitable combination of the above described embodiments.

In a second aspect, a method of making an aseptic package in a vertical form/fill/seal process comprises:

providing a lay-flat film on a first roll of film, the lay-flat film comprising a first and second surface;

providing a plurality of fitments;

unwinding the film from the first roll of film;

advancing the lay-flat film to an apparatus for attaching each of the plurality of fitments to the film;

feeding each of the plurality of fitments from a fitment feed device to the apparatus for attaching each of the plurality of fitments to the film;

attaching each of the plurality of fitments to the second surface of the film;

advancing the film, with the plurality of fitments attached to the second surface thereof, to an assembly for sterilizing the film and each of the plurality of fitments;

sterilizing the film and each of the plurality of fitments;

advancing the sterilized film, with the plurality of sterilized fitments attached to the second surface thereof, to an assembly for drying the film and each of the plurality of fitments;

drying the film and each of the plurality of fitments;

advancing the sterilized film, with the plurality of fitments attached to the second surface thereof, to a vertical form/fill seal apparatus for making a plurality of packages from the sterilized film and each of the plurality of sterilized fitments;

advancing the sterilized film over a forming device to convert the lay-flat film to a folded film having a sterilized interior surface;

advancing each of the plurality of sterilized fitments with the film such that when each of the plurality of packages are made, a fitment is disposed on an exterior surface of each package;

making a longitudinal seal in the folded film;

transversely sealing the folded film to produce a first transverse seal to define a first pouch, wherein the first transverse seal is a bottom transverse seal of the first pouch;

putting a sterilized product in the first pouch;

advancing the folded film, with the first pouch, downward a predetermined distance;

transversely sealing the first pouch to produce a top transverse seal in the first pouch, and a bottom transverse seal in a second pouch, the second pouch disposed above the first pouch; and transversely cutting the folded film to separate the first pouch from the second pouch to make a package, the package comprising a pouch comprising a first transverse seal at a first end of the pouch, a second transverse seal at a second end of the pouch, a first fold at a first side of the pouch, a second fold at a second side of the pouch, a sterilized interior surface, the exterior surface, a longitudinal seal extending from the first end of the pouch to the second end of the pouch; and an external fitment attached to the exterior surface of the pouch; and a sterilized product disposed in the pouch.

Optionally, according to various embodiments of the second aspect of the invention, separately and independently listed hereunder:

1) providing a second roll of film, a second end of the first roll of film capable of being spliced to a first end of the second roll of film.

2) the fitment feed device comprises an orienter for aligning the plurality of fitments in a pre-determined direction, and a guiding device for guiding each of the plurality of fitments to the apparatus for attaching each of the plurality of fitments to the film.

3) the fitment feed device comprises an orienter for aligning the plurality of fitments in a pre-determined direction, and a guiding device for guiding each of the plurality of fitments to the apparatus for attaching each of the plurality of fitments to the film in sequential fashion.

4) each of the plurality of fitments comprises an annular ring, and a central orifice.

5) each of the plurality of fitments comprises an annular ring, a central orifice, and an annular depression disposed on the inner surface of the annular ring.

6) attaching each of the plurality of fitments to the second surface of the film by partially attaching each of the plurality of fitments to the second surface of the film, and, at any time before making a longitudinal seal in the folded film, completing the attachment of each of the plurality of fitments to the film.

7) attaching each of the plurality of fitments to the second surface of the film by partially attaching each of the plurality of fitments to the second surface of the film with a sealing assembly wherein a seal bar seals the film to only a portion of the fitment at two regions on the fitment, the two regions spaced apart from one another.

8) attaching each of the plurality of fitments to the second surface of the film by partially attaching each of the plurality of fitments to the second surface of the film with a sealing system wherein each of the plurality of fitments comprises an annular ring, and a central orifice, and a seal bar seals the film to only a portion of the annular ring, at two regions on the annular ring, the two regions spaced apart from one another.

9) attaching each of the plurality of fitments to the second surface of the film by partially attaching each of the plurality of fitments to the second surface of the film with a sealing system wherein each of the plurality of fitments comprises an annular ring, and a central orifice, and a seal bar seals the film to only a portion of the annular ring, at two regions on the annular ring, the two regions spaced apart from one another by about 180°.

10) sterilizing the film and each of the plurality of fitments with a hydrogen peroxide bath.

11) the assembly for drying the film and each of the plurality of fitments comprises a drying chamber, wherein the drying chamber includes a tubular device for projecting sterile air onto each of the plurality of fitments as each fitment passes through the drying chamber.

12) the assembly for drying the film and each of the plurality of fitments, according to embodiment 6) above, comprises a fixed mandrel disposed opposite each fitment, that deflects the film as each fitment advances through the drying chamber, resulting in diversion of the film away from unattached portions of each fitment to facilitate drying of each fitment.

13) completing the attachment of each of the plurality of fitments to the film, according to embodiment 6) above, with a sealing assembly wherein a seal bar completes the attachment of each of the partially attached plurality of fitments to the second surface of the film.

14) the package is absent an internal fitment.

15) the package is absent an internal fitment in the vicinity of the external fitment.

The invention in accordance with the second aspect of the invention optionally encompasses any suitable combination of the above described embodiments.

In a third aspect, an aseptic package comprises:

a pouch comprising a first transverse seal at a first end of the pouch, a second transverse seal at a second end of the pouch, a first fold at a first side of the pouch, a second fold at a second side of the pouch, a sterilized interior surface, an exterior surface, a longitudinal seal extending from the first end of the pouch to the second end of the pouch; and an external fitment attached to the exterior surface of the pouch; and a sterilized product disposed in the pouch.

Optionally, according to various embodiments of the third aspect of the invention, separately and independently listed hereunder:

1) the longitudinal seal comprises a fin seal.

2) the longitudinal seal comprises a lap seal.

3) the package has no headspace.

4) the package is absent an internal fitment.

5) the package is absent an internal fitment in the vicinity of the external fitment.

The invention in accordance with the third aspect of the invention optionally encompasses any suitable combination of the above described embodiments.

In a fourth aspect, an aseptic package comprises:

a pouch comprising a first transverse seal at a first end of the pouch, a second transverse seal at a second end of the pouch, a first fold at a first side of the pouch, a second fold at a second side of the pouch, a sterilized interior surface, an exterior surface, a longitudinal seal extending from the first end of the pouch to the second end of the pouch, an external fitment attached to the exterior surface of the pouch, and a dispensing device attached to the external fitment; and a sterilized product disposed in the pouch.

Optionally, according to various embodiments of the fourth aspect of the invention, separately and independently listed hereunder:

1) the longitudinal seal comprises a fin seal.

2) the longitudinal seal comprises a lap seal.

3) the package has no headspace.

4) the package is absent an internal fitment.

5) the package is absent an internal fitment in the vicinity of the external fitment.

BRIEF DESCRIPTION OF THE DRAWINGS

The present invention is illustrated by reference to the following drawing figures, encompassing different views of various embodiments of the invention, wherein.

DEFINITIONS

Figure 1:
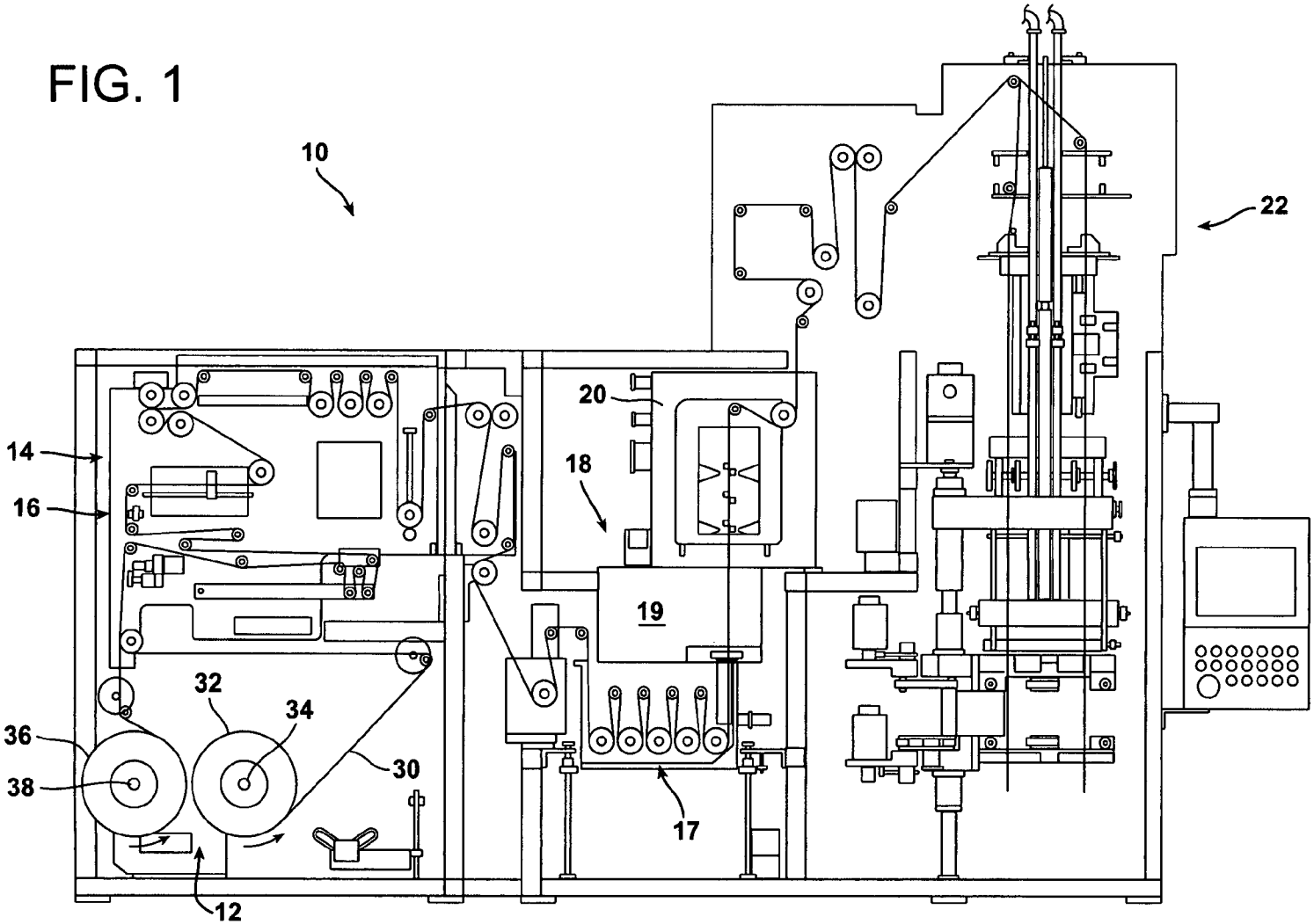
FIG. 1 is a schematic view of an aseptic packaging system and process.

"Aseptic" herein refers to a system and/or process wherein a commercially sterilized container or packaging material, e.g. a pouch constructed in a vertical form/fill/seal process, is filled with a commercially sterilized product, e.g. a food product, in a hygienic environment. The product is thus rendered shelf stable in normal nonrefrigerated conditions. "Aseptic" is also used herein to refer to the resulting filled and closed package. The package or packaging material, and the product, are typically separately sterilized before filling.

"Ethylene/alpha-olefin copolymer" (EAO) herein refers to copolymers of ethylene with one or more comonomers selected from $C_3$ to $C_{10}$ alpha-olefins such as propene, butene-1, hexene-1, octene-1, etc. EAO includes heterogeneous materials such as linear medium density polyethylene (LMDPE), linear low density polyethylene (LLDPE), and very low and ultra low density polyethylene (VLDPE and ULDPE); single-site catalyzed materials such as homogeneous linear ethylene/alpha olefin copolymers and long chain branched ethylene/alpha olefin copolymers; and multicomponent ethylene/alpha-olefin interpenetrating network resin (or "IPN resin").

"Fig." herein refers to drawing figure; "Figs." to drawing figures.

"Film" is used herein to mean a thermoplastic film, laminate, or web, either multilayer or monolayer, that may be used in connection with the present invention. Film can be of any suitable thickness, e.g. between 0.1 and 30 mils.

"Fin seal" is used herein to mean folding one edge of a film towards the opposite edge of the film, and sealing the facing inner surfaces together.

"External fitment" is used herein to mean a device that can be attached to a surface of a film, the film to be made into a pouch wherein the surface forms the exterior surface of the pouch, wherein the pouch can be filled with a sterile product and sealed to form an aseptic package, and wherein the external fitment facilitates the removal of the sterile product from the package.

"Internal fitment" is used herein to mean a device that can be attached to a surface of a film, the film to be made into a pouch wherein the surface forms the interior surface of the pouch, wherein the pouch can be filled with a sterile product and sealed to form an aseptic package, and wherein the internal fitment facilitates the removal of the sterile product from the package.

"Lap seal" is used herein to mean a seal made by sealing an inside surface of a film to an outside surface of a film.

"Longitudinal seal" herein refers to a fin seal or lap seal.

"Olefinic" and the like herein refers to a polymer or copolymer derived at least in part from an olefinic monomer.

"Oxygen barrier" and the like herein refers to materials having an oxygen permeability, of the barrier material, less than 500 $cm^3$ $O_2/m^2$·day·atmosphere (tested at 1 mil thick and at 25° C., 0% RH according to ASTM D3985), such as less than 100, less than 50, less than 25, less than 10, less than 5, and less than 1 $cm^3$ $O_2/m^2$·day·atmosphere. Examples of polymeric materials useful as oxygen barrier materials are ethylene/vinyl alcohol copolymer (EVOH), polyvinylidene dichloride (PVDC), vinylidene chloride/methyl acrylate copolymer, vinylidene chloride/vinyl chloride copolymer, polyamide (nylon), and polyester (PET).

"Polymers" and the like herein means a homopolymer, but also a copolymer thereof, including terpolymer, tetrapolymer, block copolymer, etc.

"Pouch" herein means a pouch or bag.

"Registration device" herein refers to any mark, such as an eye spot, pattern, or feature of a film, that facilitates the advancement of the film, in a controlled manner, into and/or through a packaging machine, where the film is used to make individual packages. The device can be e.g. printed or placed in uniformly spaced fashion along or near an edge of the web or discrete tape, i.e. registration marks, or in an area near the middle of a web that does not interfere with decorative printed graphics. These marks are used in connection with appropriate sensors to controllably advance the film. In the present invention, the external fitments can function as a registration device, and can be detected by sensors, and it may not be necessary to print registration marks on the film.

"Seal" herein means a bond between two thermoplastic surfaces, e.g. as produced by heat sealing, radio frequency (RF) sealing, ultrasonic sealing, or the like. "Sealant" is a polymeric material or blend of materials, such as olefinic polymer or copolymer such as an ethylenic polymer or copolymer, that can form a surface of the film and form a bond between two thermoplastic surfaces.

"Thermoplastic" herein includes plastic materials that when heated to a softening or melting point may be reshaped without significant thermal degradation (burning). Thermoplastic includes both materials that are not crosslinked, or that are crosslinked by chemical or radiation means.

All compositional percentages used herein are presented on a "by weight" basis, unless designated otherwise.

Drawings herein are not necessarily to scale, and certain features of the invention may be graphically exaggerated for clarity.

DETAILED DESCRIPTION OF THE INVENTION

1. Aseptic Packaging System and Process

In one embodiment, the system in accordance with the invention is an automated vertical form/fill/seal (VFFS) system for aseptically packaging pumpable products, including liquid products and those with small particulates. The system in one embodiment is a single head stainless steel apparatus that can produce packages with headspace or no headspace. The finished packages can be used in e.g. retail and food service (hospital, restaurant, or institutional) end-use applications. Packages of e.g. from 3 to 10 liters in volume, e.g. 2 to 10 liters or 2 to 5 liters, can be produced. With appropriate modifications, packages smaller or larger than these volumes can be produced. A moving cooling bar can be used in connection with the production of transverse seals during the packaging process, to accelerate cooling of the transverse seals. Coextruded or laminated films, printed or unprinted, can be used in the production of aseptic packages. Eye spots or other registration marks can optionally be installed on lay-flat film for use in the system, to control the production length of individual packages. The external fitments themselves once installed on the film can serve as registration marks with suitable use of sensors to control the production of packages. The system uses in one embodiment servocontrol for most motions and a single PLC (programmable logic controller with suitable software) to control all system functions.

A. Film Unwind Device

The aseptic packaging system 10 in accordance with the invention includes a film unwind device 12 for unwinding a film.

Thermoplastic film 30 is stored on a first roll 32 supported by first film support shaft 34. The film 30 is fed from the roll 32 as needed and advanced as described further herein. Optionally, in one embodiment, a second roll 36 of film 30 is supported on a second film support shaft 38. The first and second film support shafts are located at one side of the system to allow easy access to the system for film changeovers. An empty roll can be substituted with a full roll without interrupting the operation of the system. Automatic splicing of a second end of film 30 of roll 32 to the first end of film 30 of roll 36 can be accomplished by a film splicer assembly mounted just above the respective film shafts. The film is spliced during the changeover from one roll of film to the other with a constant heat seal bar. A sensor detects the second end of the film of roll 32 and activates an automatic splicing sequence, the sensor activated by a transverse tape located near the second end of the film 30 of roll 32. The pouch ultimately made that includes the film splice is rejected by the operator when the pouch is made on the VFFS apparatus (described further below) and a double package is produced. This pouch is rejected.

B. Fitment Feed Device

The aseptic packaging system in accordance with the invention includes a fitment feed device 14 for feeding a plurality of fitments 302.

Figure 2:
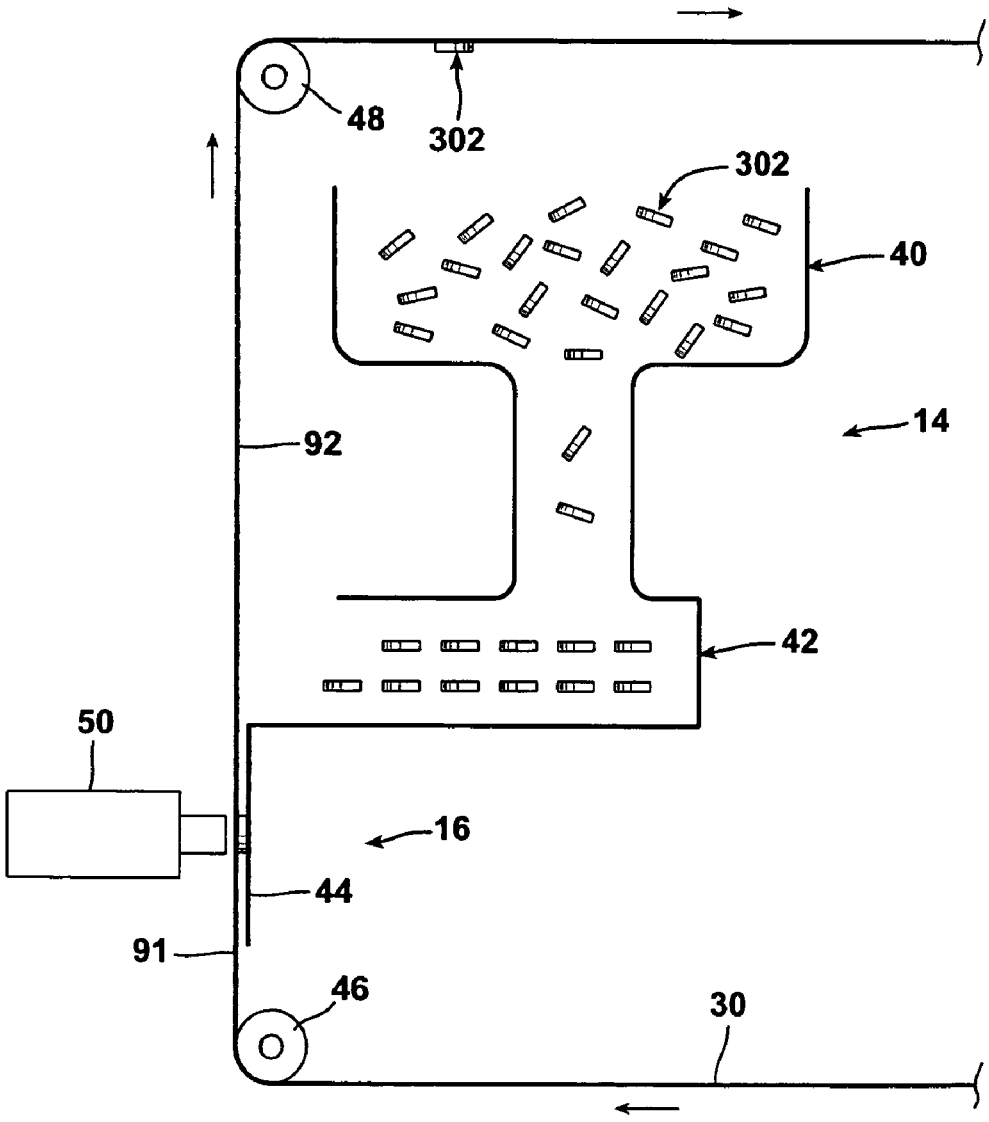
FIG. 2 is a schematic view of a fitment feed device for feeding a plurality of fitments, and an apparatus for attaching each of the plurality of fitments to a film.

Fitments 302 are put into a hopper 40. These fitments 302 are then run through an orienter 42 to align the fitments in an appropriate direction. Fitments 302 are fed, for example in individual sequence, by suitable motive force, or gravity, to a guiding device 44 that aligns each fitment adjacent film 30 advancing from film unwind device 12. As shown in FIG. 2, in one embodiment guide rollers 46 and 48 direct the advancement of film 30 so that the film can be brought into adjacent relationship to a lead fitment 302. For purposes of the invention, suitable alternatives to the orienter and guiding device can be used as long as ultimately a series of fitments are fed in sequential fashion (individually or in groups of fitments) to a location where the fitments are sequentially and controllably attached to the film passing through this portion of system 10, followed by advance of the film with a now attached fitment, and advancement of a sequential fitment to the same location for attachment to the film, and so on.

Figure 5:
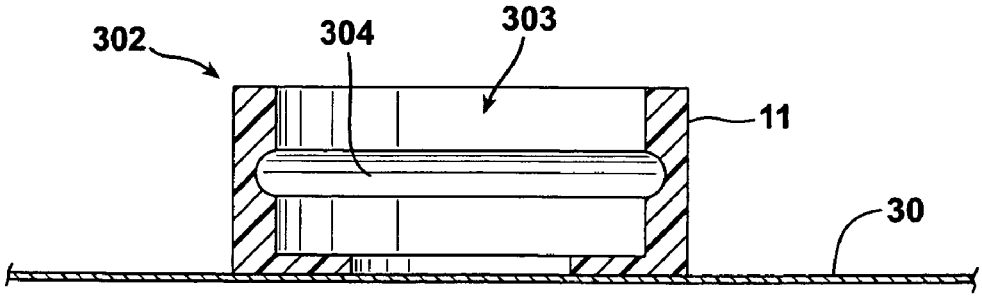
FIG. 5 is a cross-sectional view of an external fitment attached to the film.

The fitments 302 can be of any suitable shape, size, and composition. In one embodiment, the fitment design is of the type shown in FIGS. 3 and 5. A common feature of any suitable fitment is that a pouch made from a film carrying the fitment can be filled with a sterile product and sealed to form an aseptic package, wherein the fitment is located outside the package, i.e. on the exterior surface of the package, and the fitment facilitates the removal of the sterile product from the package, e.g. by gravity or pumping, using a suitable external tap or pump device.

C. Apparatus for Attaching each of the Fitments to the Film

The aseptic packaging system in accordance with the invention includes an apparatus 16 for attaching each of the plurality of fitments to the film (see FIG. 2).

Film 30 is advanced past guide roller 46, and into adjacent alignment with the lead fitment 302, the film disposed between fitment 302 and an attaching device such as a heat sealer 50. Thus, the film 30 passes between the attaching device and the lead fitment. When each fitment is appropriately positioned relative to and adjacent the film, the attaching device is activated to press and seal the film to one planar surface of the fitment. Guiding device 44 acts as a sealing anvil in facilitating attachment of the film to the fitment. After the fitment has been attached to the film, the film is advanced toward a sterilizing assembly to be described further below.

In this sealing operation, a constant heated seal head can be used to effect attachment of the film to the fitment.

An advantage of the present invention is that heat supplied from a sealing device, such as a sealing bar or seal head, is directed as shown through the film to the relevant surface of the fitment. This facilitates the attaching step. The alternative of attaching the fitment to the film by applying heat through the fitment to the film is more difficult to accomplish.

Fitments are attached at pre-determined intervals to the film, the gap between sequential fitments pre-determined based on the desired length of each pouch made in the downstream VFFS apparatus, and the ultimate desired length of each final aseptic package.

Figure 3:
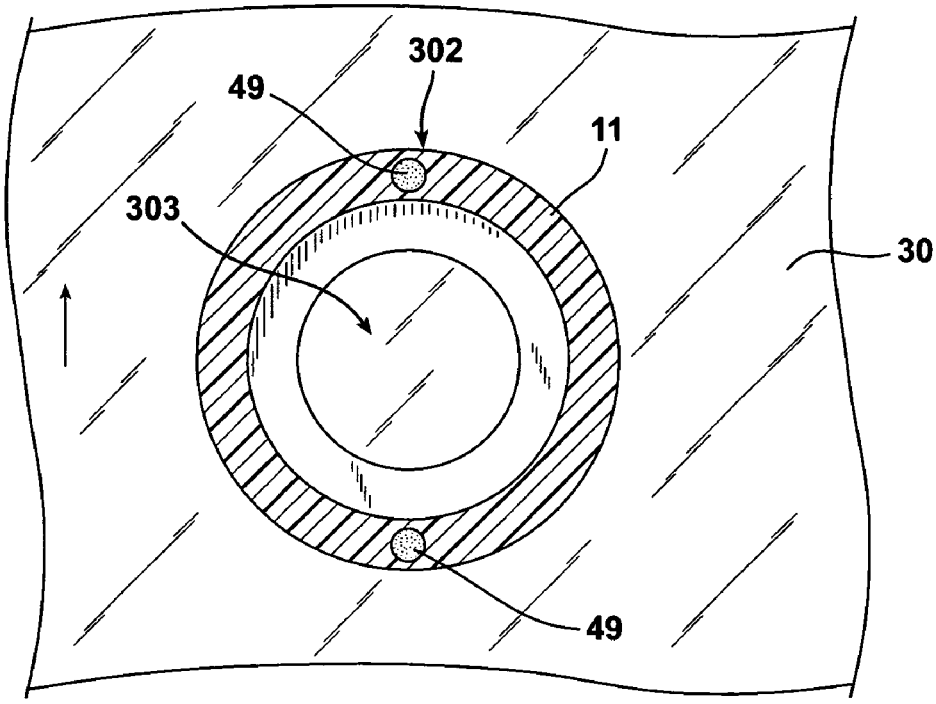
FIG. 3 is an end view of an external fitment attached to the film.

With reference to one embodiment of the invention, a fitment as shown in FIG. 3 can be used in connection with the invention. The fitment 302 exemplified in FIG. 3 includes an annular ring 11 with a central orifice 303. The orifice 303 permits contained sterile product to flow through fitment 302 to the exterior of a package made from a film carrying external fitment 302, when access is made to the package by piercing film 30 in the vicinity of orifice 303 of fitment 302. Any suitable alternative fitment design can be used in conjunction with the present invention. The fitment 302 can be of any suitable diameter and thickness. In one embodiment, the annular ring includes on its internal surface an annular depression 304 (see FIG. 5) to facilitate connection of the fitment to a dispensing device. Annular depression 304 provides for a snap fit to a mating component of a dispensing device. An example is shown in FIGS. 15 to 20.

In one embodiment of the invention, the apparatus 16 only partially attaches each of the plurality of fitments to the film. As shown in FIG. 3, there are two regions of attachment 49 of film 30 to fitment 302. Attachment can be at any suitable location on the fitment, and can be more specifically at any suitable location on the annular ring. In one embodiment, the two regions of attachment define a line parallel to the direction of travel of the film, this embodiment proving particularly useful during the drying process described further herein. In another embodiment, only one region of attachment can be present; alternatively, more than two regions of attachment can be present. In each embodiment, a portion of the fitment in contact with the film, or a portion of the surface of the annular ring adjacent the film, is not sealed to the film at this stage of the system and process.

Partial sealing of the fitment to the film, and in particular sealing at two spaced apart regions on the annular ring of the fitment, provides two advantages.

The first advantage is that the fitment is secured to the film as it advances with the film through the remainder of the system, but with sufficient flexibility that the fitment is not dislodged from the film as the film travels with many changes of direction through the system.

The second advantage is the ability to more thoroughly dry the fitment after the sterilizing process described in more detail below.

Film Tensioning during Film Unwind

The system benefits from a film tensioning assembly including freewheeling rollers, nip rollers, and dancer rollers, all working together to unwind the film from the roll with the right tension. Servomotors drive the nip rollers. Several microswitches, that detect the dancer roller position, control the film speed. When the system is started, the film, drawn by a main motor, forces the dancer rollers to move upward, activating a microswitch. This action starts the nip roller motors. If the motor speed is too low, the dancer roller continues to move upwards and activates a second microswitch, which increases the nip roller speed to a certain degree. If the dancer roller activates a third microswitch, the nip roller speed is further increased, and so on. The higher the dancer roller, the higher the nip roller speed. The dancer stops rising when the film speeds, upstream and downstream of the dancer roller, are the same. When the main motor is stopped, the nip rollers feed the film to the dancer, which starts to move downward. The process just described then operates in reverse: the speed is decreased and, when the dancer roller reaches the lowest position, the nip roller motors stop running. When the film splice (if done) and partial or complete fitment seal is made, film unwinding is stopped. The film tensioning assembly can release enough film during this time to make sure that the packaging operation can continue. The film unwind device is equipped with a proximity switch that shuts the packaging system down if the system runs out of film. The proximity switch can be of the optical type, wherein the switch is activated when there is no film in its view.

D. Assembly for Sterilizing the Film and Fitments

Figure 4:
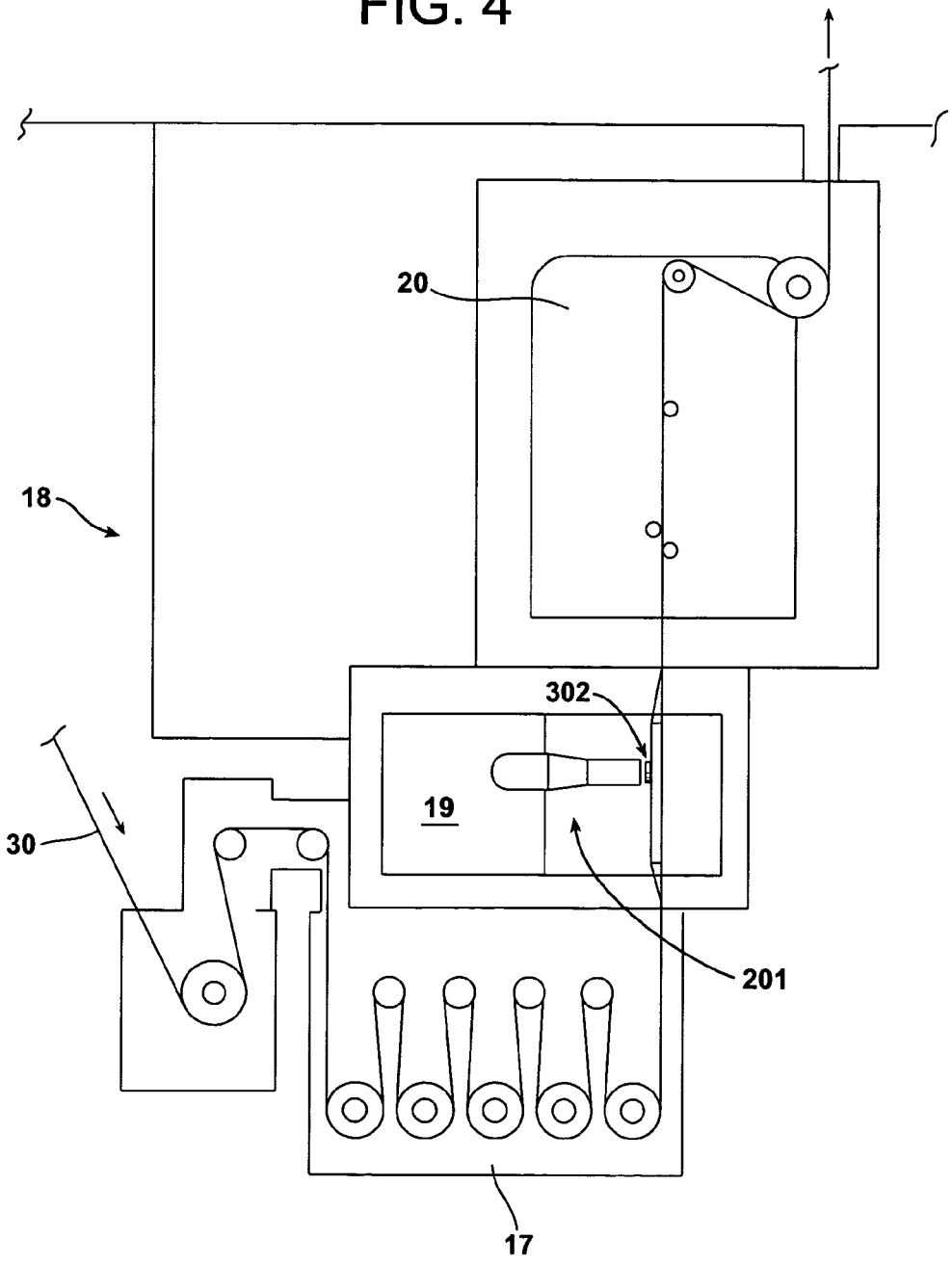
FIG. 4 is a schematic view of an assembly for sterilizing the film and each of the plurality of fitments, and an assembly for drying the film and each of the plurality of fitments.
Figure 6:
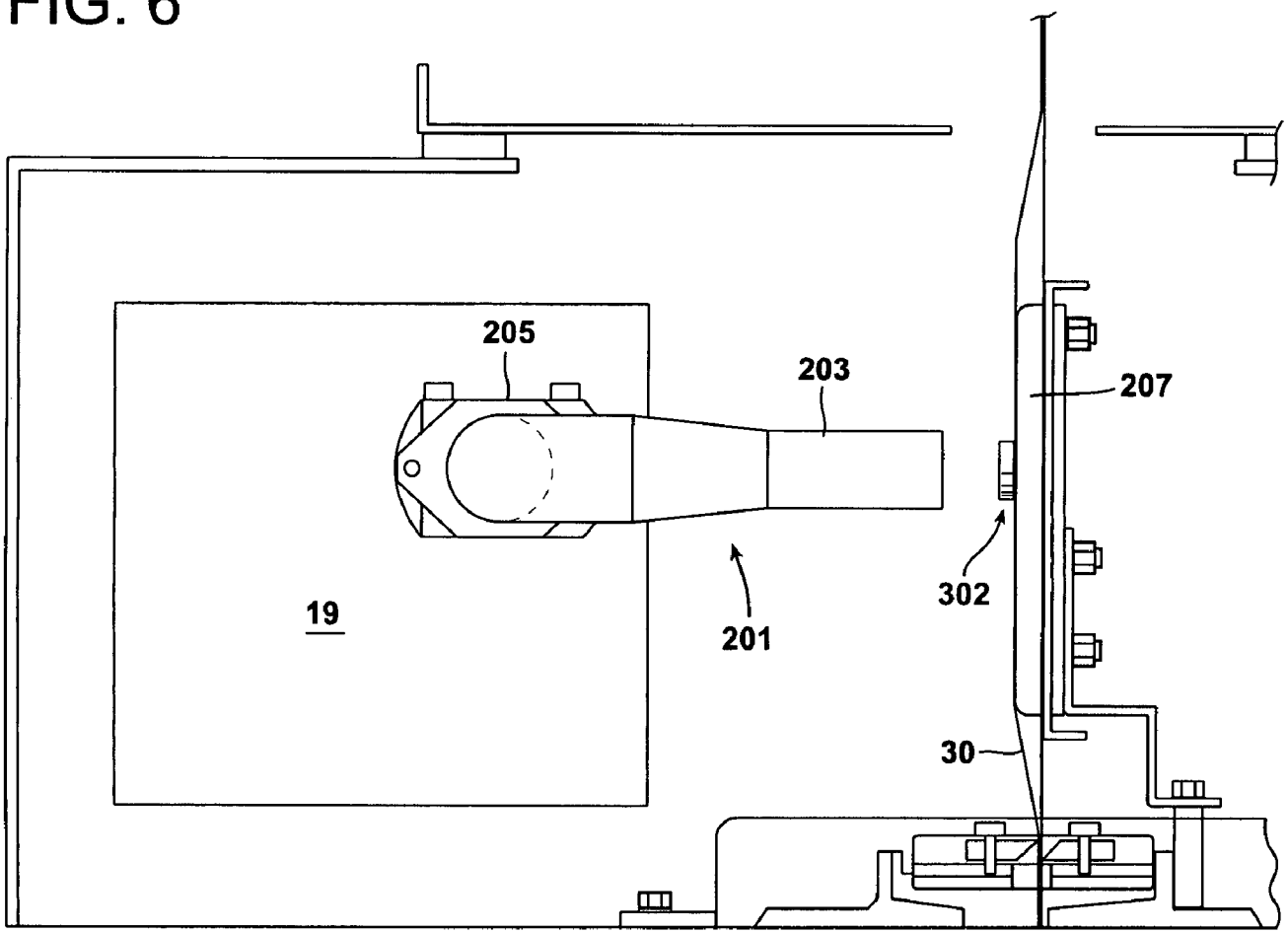
FIG. 6 is an enlarged view of an assembly for drying the film and each of the plurality of fitments.

The aseptic packaging system in accordance with the invention includes an assembly 17 for sterilizing the film and each of the plurality of fitments (see FIGS. 1 and 4).

After passing through the apparatus for attaching each of the plurality of fitments to the film, the film with attached fitments passes through a series of rollers into a sterilization unit, e.g. a hydrogen peroxide dip tank. The dip tank in one embodiment is equipped with a series of rollers over which the film is advanced. This arrangement helps to provide sufficient time in the dip tank so that the film and fitments are adequately sterilized. The temperature of the hydrogen peroxide in the dip tank is regulated, and kept at typically 60° C. The concentration of the hydrogen peroxide is monitored, and is typically between 32% and 35%. When the film exits the hydrogen peroxide bath the film is sterilized, and enters the sterile zone of the system.

E. Assembly for Drying the Film and Fitments

The aseptic packaging system in accordance with the invention includes an assembly 18 for drying the film and each of the plurality of fitments (see FIGS. 1, 4, and 6 to 9).

In one embodiment, the assembly for drying the film and fitments includes a first drying chamber 19 in which an air knife is used to dry the film. Sterile hot air from a suitable supply of sterile hot air is blown onto the film. In one embodiment, the film is moving in an upwardly vertical direction as it leaves sterilizing assembly 17, enters first drying chamber 19, and then exits chamber 19 and enters a second drying chamber 20. Drying chamber 19 includes a blower 201, e.g. in the form of an air knife. Blower 201 includes in one embodiment a straight section 203 and a curved section 205. An example is a curved pipe through which heated sterile air, from a suitable source of sterile air, is forced at high pressure through curved section 205 and straight section 203 onto each fitment 302 as each of the plurality of fitments 302 sequentially pass a fixed location in chamber 19, each fitment partially or completely attached to second surface 92 of film 30, the film being advanced upwardly through chamber 19.

A challenge in drying each fitment 302 is to remove enough of the residual hydrogen peroxide from the surfaces of the fitment, after sterilization, to ensure that the final aseptic package, with a fitment 302 attached to an exterior surface of the package, will meet regulatory requirements with respect to the total maximum amount of residual hydrogen peroxide permissible in the package. In one embodiment, by partially but not totally sealing the fitments to the film before the sterilization steps, the fitment can be more thoroughly dried after the sterilization step. This is accomplished by creating a gap between unsealed portions of the fitment, and underlying portions of the film. This can be seen e.g. in FIG. 8. As the film 30 with the attached fitment 302 moves upwardly through drying chamber 19, optionally the film passes over mandrel 207. This results in a diversion of the film away from the surface of fitment 302, except in the portion of the fitment where the film has been previously sealed to the fitment in apparatus 16, at regions of attachment 49. Regions 49 can in one embodiment be heat seals. The diversion of the film allows sterile air from blower 201 to circulate around fitment 302 to facilitate drying of fitment 302 and film 30. As the film with attached fitment advances further, the film returns to its previous position relative to fitment 302.

Figure 7:
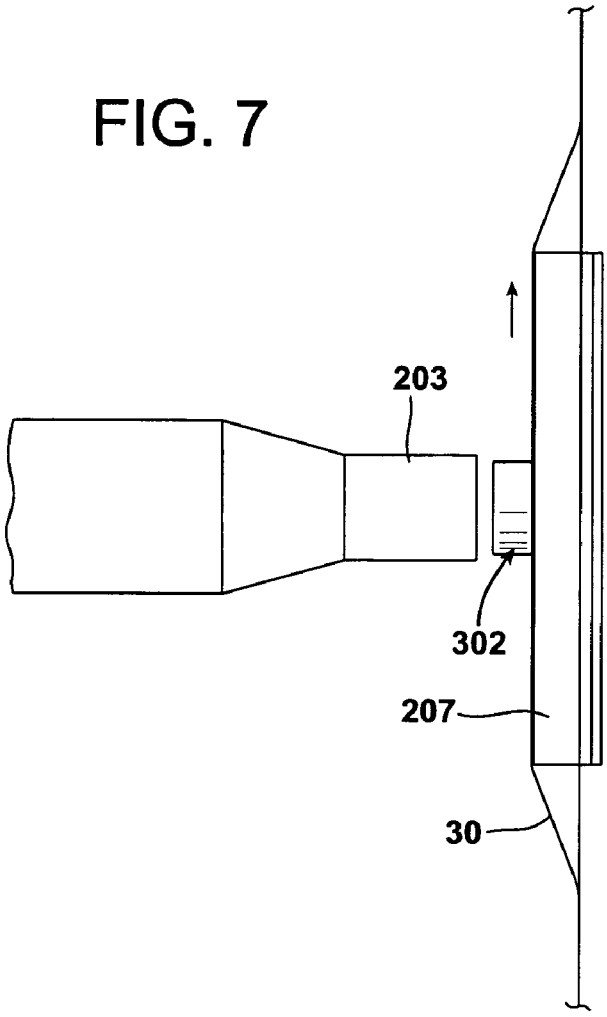
FIG. 7 is a side schematic view of a portion of an assembly for drying the film and each of the plurality of fitments.
Figure 8:
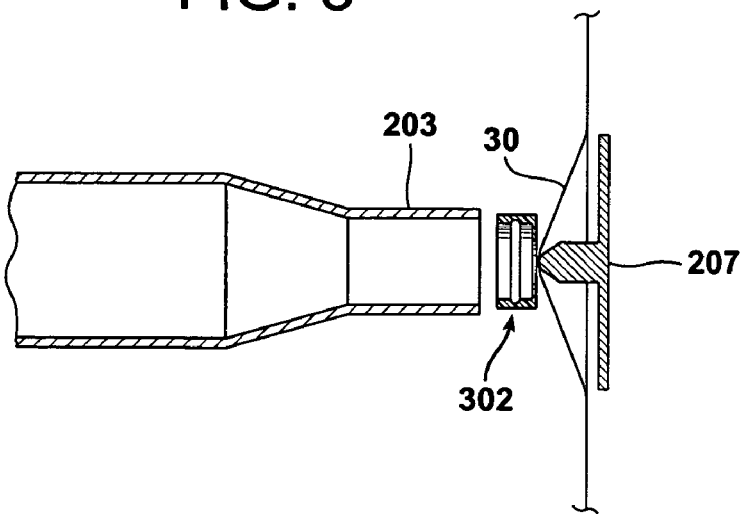
FIG. 8 is a top schematic view of an assembly for drying the film and each of the plurality of fitments.
Figure 9:
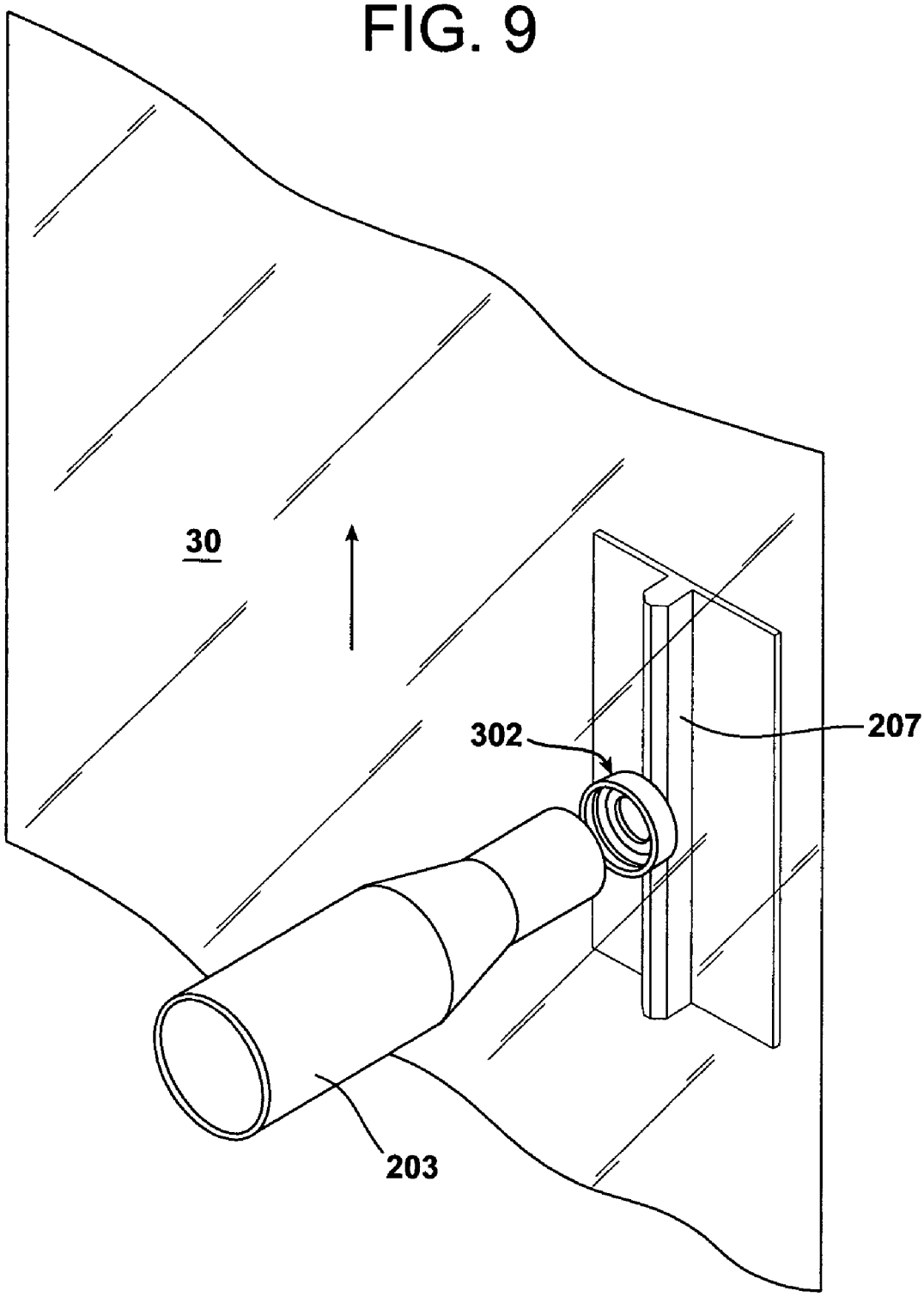
FIG. 9 is a perspective view of an assembly for drying the film and each of the plurality of fitments.

As shown in FIG. 3, the two regions of attachment 49, created upstream of the sterilization process, are in one embodiment arranged vertically, i.e. parallel to the direction of film movement through the system (see arrow in FIG. 3), so that when sterilized film reaches chamber 19, and advances over mandrel 207, the film is forced outwardly in a direction at right angles to the general direction of film movement through the drying assembly. As shown, FIG. 7 is a side schematic view of a portion of an assembly for drying the film and each of the plurality of fitments, with mandrel 207 providing a vertically extended edge (see also FIG. 9) along which the film is forced outwardly, and along which extent the film is diverted away from the surface of fitment 302, except in the portion of the fitment where the film has been sealed to the fitment.

Alternative arrangements are also within the scope of the invention. For example, the two regions of attachment 49 could be arranged horizontally, i.e. at a right angle to the direction of film movement through the system. In this alternative, mandrel 207 can be rearranged to provide a horizontally extended edge. In such an alternative arrangement, FIG. 7 would represent a top schematic view of a portion of an assembly for drying the film and each of the plurality of fitments, and FIG. 8 would represent a side schematic view of an assembly for drying the film and each of the plurality of fitments.

Any arrangement of regions of attachment 49 between these two embodiments is also possible.

The assembly for drying the film and fitments in accordance with the invention can utilize a blower of any suitable configuration, and a mandrel of any suitable shape, provided they adequately dry the film and fitments.

Those of skill in the art will recognize, after a review of this embodiment of the present invention, that an external fitment of any suitable configuration can benefit from the invention, in that a planar surface of circular or any other geometry can be partially sealed to a surface of a film, and thereafter diverted as shown herein to permit drying air to circulate around the fitment and effect adequate drying of the partially attached fitment and film in the vicinity of the fitment.

The second drying chamber 20 can include a drying device such as an air manifold through which heated, sterilized air is forced onto the film and external fitments to further dry them.

The first and second drying chambers, as well as the subsequent downstream chambers of the system and process of the invention, up to the lower portion of the VFFS apparatus described below, are kept in an overpressure condition during packaging to ensure that sterilized air is present in the system, and environmental air does not enter the system to compromise the aseptic condition of the film, contained product, or resulting package.

Film Tensioning and Film Guiding after Film Sterilization and Drying

After the film and each of the plurality of fitments have been sterilized and dried, the film with attached fitments is advanced through a film guiding assembly, and a film tensioning assembly that operates similar to the upstream film tensioning assembly described above with respect to film unwind. The film guiding assembly ensures consistent film tracking. The film tensioning assembly includes dancer rollers and nip rollers, with servomotors to drive the nip rollers. For the packaging operation the film is indexed only a certain time. The film tensioning assembly makes the film speed on the air knife side of the film during the drying step more consistent by releasing additional film during the film index, and accumulating film during the film stopping period of the packaging operation. The film guiding assembly and the film tensioning assembly are disposed in an aseptic chamber located downstream of the second drying chamber 20.

F. Vertical Form/Fill Seal Apparatus

The aseptic packaging system in accordance with the invention includes a vertical form/fill seal apparatus 22 for making a plurality of packages from the sterilized film and each of the plurality of sterilized fitments.

Figure 10:
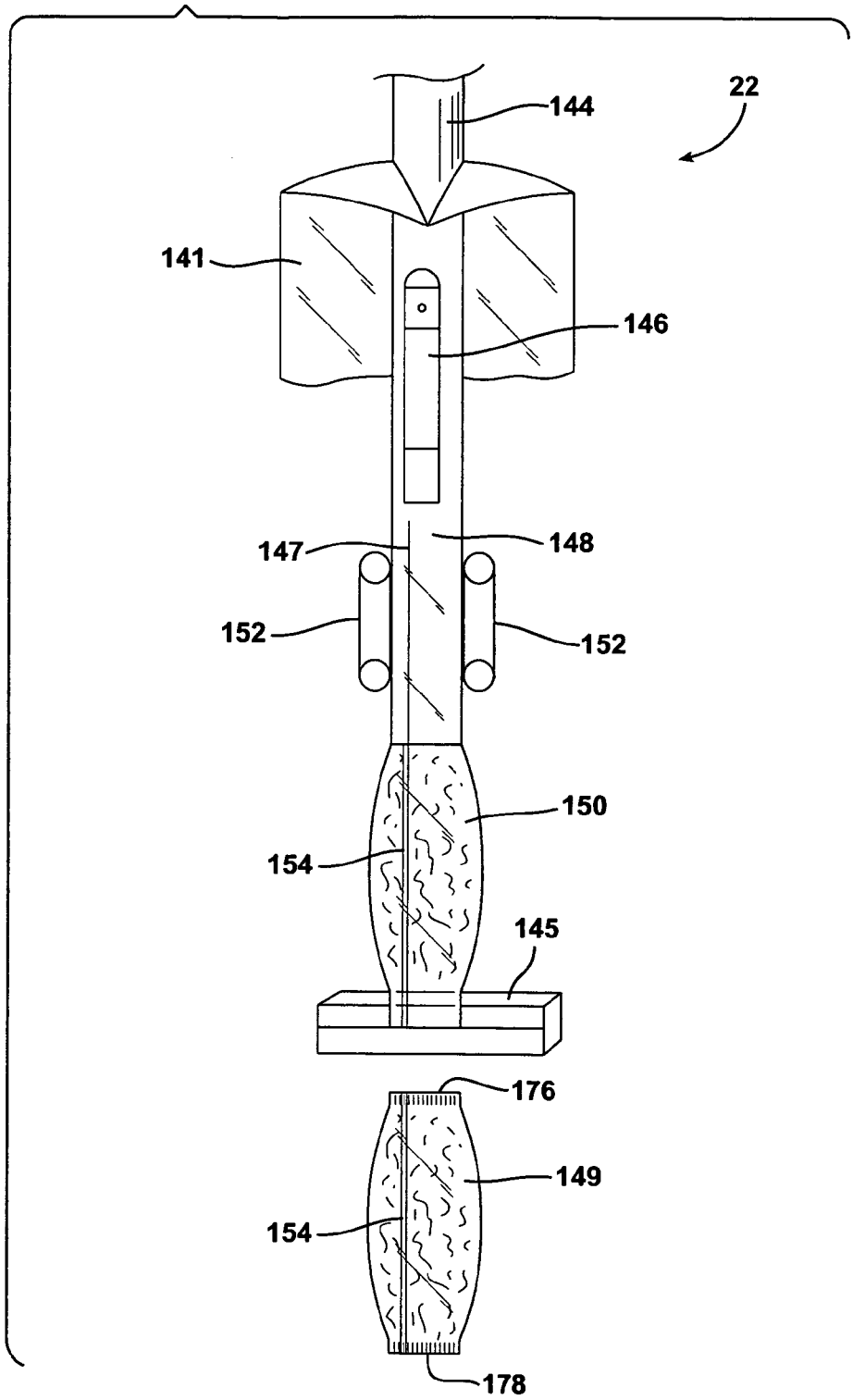
FIG. 10 is an elevational view of a VFFS process and apparatus for making an aseptic package.

FIG. 10 schematically illustrates a VFFS apparatus 22 that can be used as part of the system and process of the present invention. VFFS packaging systems are generally well known to those of skill in the art, and described for example in U.S. Pat. No. 4,589,247 (Tsuruta et al), U.S. Pat. No. 4,656,818 (Shimoyama et al.), U.S. Pat. No. 4,768,411 (Su), U.S. Pat. No. 4,808,010 (Vogan), U.S. Pat. No. 5,467,581 (Everette), U.S. Pat. No. 6,244,747 (Caudle), and US Patent Application Publication No. US 2006/0111224 (Caudle), all incorporated herein by reference in their entirety.

Apparatus 22 utilizes a lay-flat film 141. Film 141 represents and is equivalent to film 30 after a plurality of fitments have each been partially or completely attached thereto at a second surface of the film, and after the film and fitments have been sterilized and dried in the sterilizing and drying processes disclosed herein, and the film with fitments advanced to apparatus 22. Film 141 includes a plurality of fitments 302 each partially or completely sealed to the film at predetermined intervals.

Figure 13:
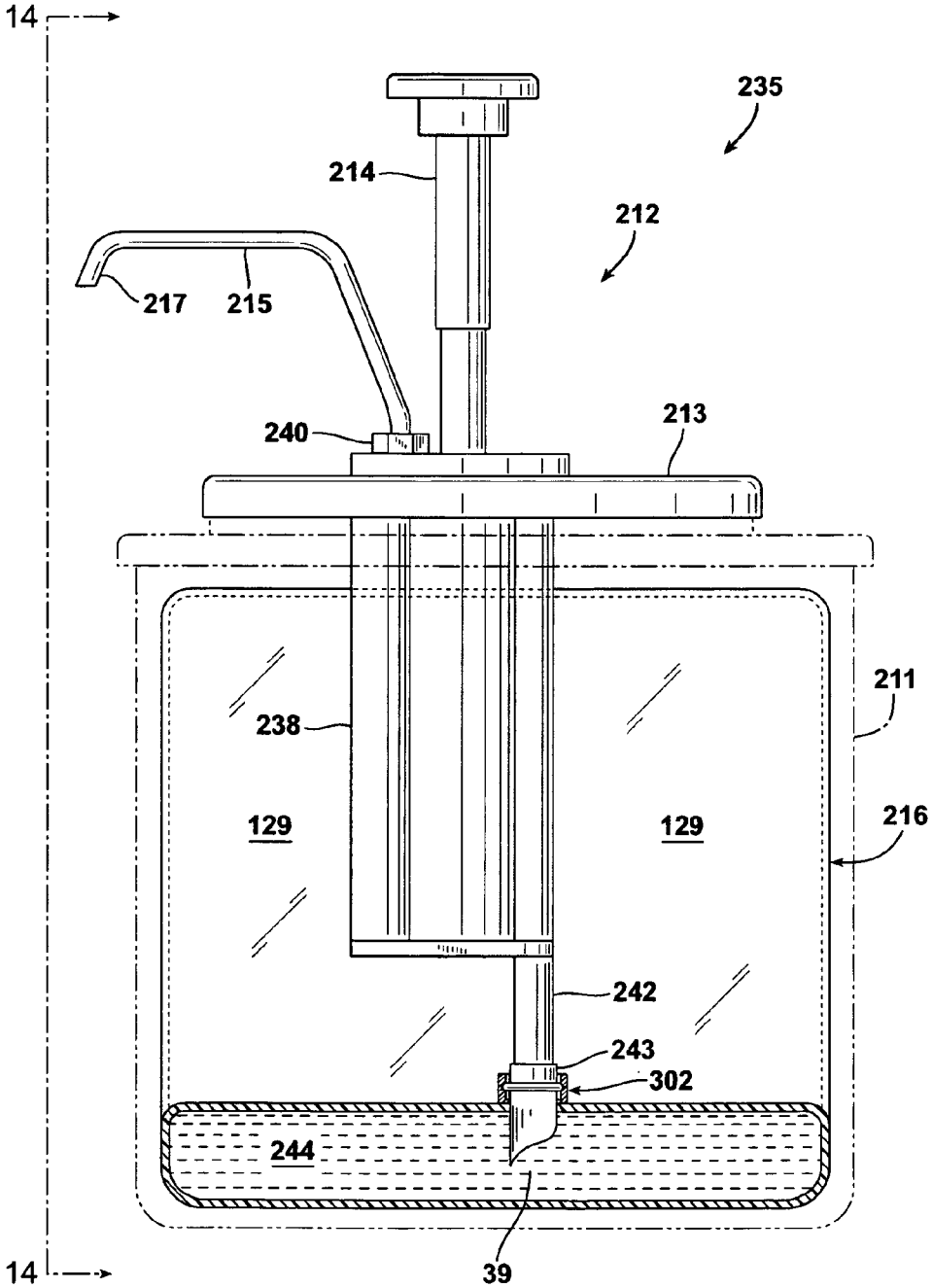
FIG. 13 is a side elevational partially cut-away view of a system for dispensing a pumpable sterilized product.

A sterilized product, depicted as 244 in FIG. 13, is manually or mechanically supplied to apparatus 22 from a product sterilization unit (not illustrated), from which a predetermined quantity of the sterilized product reaches the upper end portion of forming tube 144 via any conventional means, such as a funnel or feed tube.

The sterilized product can be any food or non-food product, liquid, semi-liquid, or paste, e.g. flowable or pumpable high acid or low acid foods, such as tomato products, milk or dairy products, medical products, or the like.

Packages are formed in a lower portion of apparatus 22. Film 141 from which the packages are formed is advanced from assembly 18, over forming tube 144 (sometimes known as a "sailor's collar" or "forming collar") and is provided with a longitudinal fin seal or lap seal 147 by longitudinal heat sealing device 146, resulting in the formation of a vertically-oriented folded film in the form of a tube 148. Transverse heat seal bars 145 operate to close and seal horizontally across the lower end of vertically-sealed tube 148, to form a pouch 149 which is thereafter packed with sterilized product. Film drive belts 152, powered and directed by rollers, as illustrated, or by suitable alternative motive means, advance tube 148 and pouch 149 a predetermined distance, after which seal bars 145 close and simultaneously seal horizontally across the lower end of vertically-sealed tube 148 as well as simultaneously sealing horizontally across upper end of sealed pouch 149, to form a product packaged in sealed pouch 149. The next pouch 150, thereabove, is then filled with a metered quantity of sterilized product, and advanced downwardly, and the packaging cycle is repeated. It is conventional to incorporate with seal bars 145 a cut-off knife (not shown) which operates to sever a lower sealed pouch 149 from the bottom of upstream pouch 150.

Lay-flat film 141 of FIG. 10 will in operation travel typically vertically downward from the forming tube 144.

In some embodiments, the film 141 can carry a registration device. Printed indicia can be in the form of registration marks, such as eye-spots. Alternatively, each of the plurality of fitments 39 can function as a registration device.

Fitments 302, present on lay-flat film 141, are not shown in FIG. 10.

In one embodiment, fitments 302, as they advance with film 141 over forming tube 144, have each already been partially sealed to the film by apparatus 16 as described above and shown in FIGS. 2 and 3. At any suitable time during the VFFS process, each fitment is completely attached to the film, i.e. the VFFS apparatus includes a device for completing the attachment of each of the partially attached fitments to the film. This device can be e.g. a sealing device such as a heat sealer. The heat sealer can be substantially the same as heat sealer 50 as shown in FIG. 2. In one embodiment, the device can be located below or downstream of forming tube 144, and above or upstream of longitudinal heat sealing device 146.

2. Aseptic Package

Figure 11:
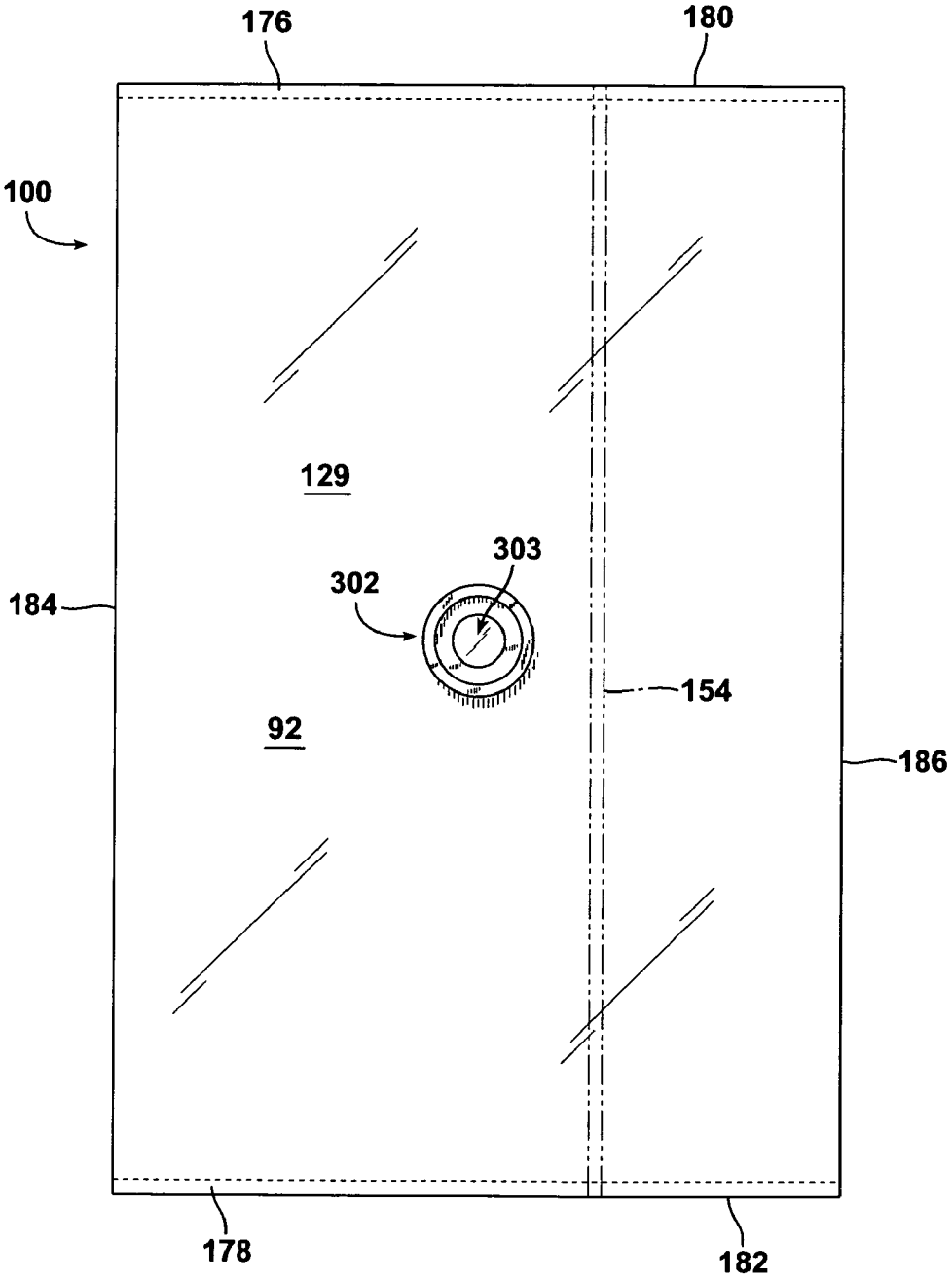
FIG. 11 is a plan view of an aseptic package with an external fitment.
Figure 12:
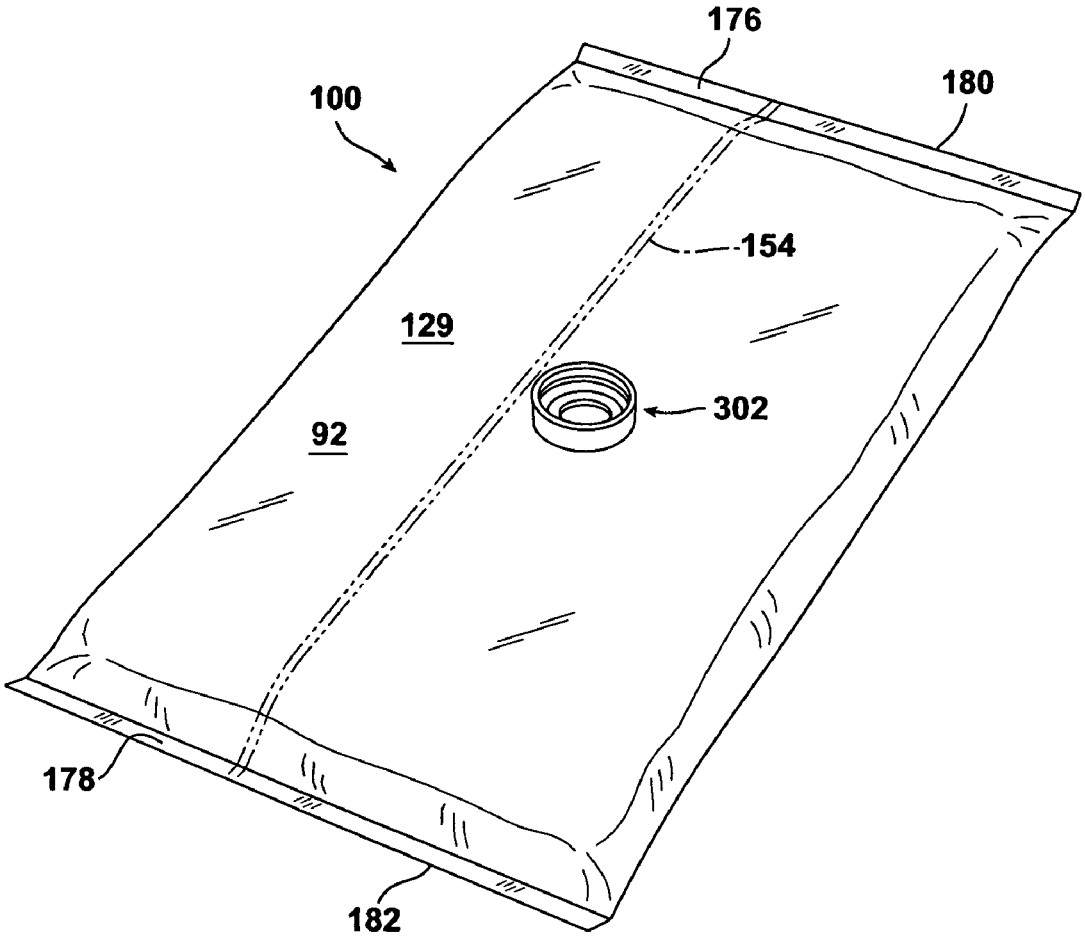
FIG. 12 is a perspective view of an aseptic package with an external fitment.

In FIGS. 11 and 12, an aseptic package 100 in accordance with the invention is shown in plan and perspective views respectively. The package 100 includes a first transverse seal 176, a second transverse seal 178, and a longitudinal seal 154. The package includes a first wall 129 having an outer surface 92 and an inner surface 91, corresponding to second surface 92 and first surface 91 respectively of film 30. A fitment 302 is completely attached to the outer surface 92 of the first wall 129. First and second longitudinal ends 180 and 182 respectively of the package are defined by the outer longitudinal extremities of first transverse seal 176 and second transverse seal 178 respectively. In some embodiments, some unsealed pouch material can be present between the outer longitudinal edge of a transverse seal, and the actual respective longitudinal edge of the pouch itself. Such embodiments are also contemplated within the scope of the present invention. The package 100 also includes a first lateral edge 184 and a second lateral edge 186. Edges 184 and 186 will typically be a fold, reflecting the tubular film from which the package was made in the VFFS process and apparatus. The package 100 contains a sterilized product.

Method of Operation

The package of the invention can be used in connection with any suitable dispensing tap, spout, dispensing pump, or other device for removal of sterilized product from the interior of the package by e.g. gravity or vacuum.

In one embodiment, FIG. 13 shows a side elevational partially cut away view of a system for dispensing a pumpable sterile product. The system 235 includes a product well 211 and a pump device 212. In the drawing of FIG. 13, the package 216 (equivalent to package 100 of FIGS. 11 and 12) has been disposed in a generally U-shaped arrangement in product well 11 (shown in phantom here so that other features of the invention can be more clearly shown). The package can alternatively be placed in any suitable orientation, e.g. as would typically be used in bag-in-box or other commercial package configurations. Likewise, although fitment 302 is shown as centrally disposed in the package with respect to the first and second edges and first and second ends of the package, fitment 302 can be disposed at any convenient location on an interior surface of the package.

The pump device 212 includes the cover 213, piston 214, and discharge tube 215 terminating in dispensing nozzle 217. The piston and discharge tube, along with the pump device body 238, are secured to the cover 213 by means of fastener 240. A drawing tube 242 on the lower portion of the pump device body terminates in a piercing nozzle 243.

Piercing nozzle 243 is punched through orifice 303 of fitment 302 and then through the wall of package 216 such that nozzle 243 communicates with the contained sterilized product 244. In one embodiment, this piercing nozzle can be attached to a conventional drawing tube of a conventional pump device. Many alternative embodiments are possible, however, and any are suitable provided that a fitment 302 disposed on an exterior surface of the pouch is positioned to facilitate removal of product from the package. A contained sterilized product 244, such as a milk product, tomato product, or other pumpable food or non-food product, can thus be dispensed, upon activation of the pumping device by any suitable means such as mechanical or electromechanical means, through fitment 302 and piercing nozzle 243, up through drawing tube 242, up through pump device body 238, to discharge tube 215 and out through dispensing nozzle 217.

Piercing nozzle 243 can be e.g. of the general type disclosed in the Stern patent (U.S. Pat. No. 4,603,793), referred to above, but can be of any suitable configuration and geometry. An advantage of the particular fitment 302 disclosed in the drawings, is that any suitable dispensing device can be attached to fitment 302, by any suitable interlocking means such as a snap fit (as shown in the drawings), interference fit, threaded fit, etc. The dispensing device can be installed by the food processor soon after the package is made, or can be installed later, e.g. just before access to the sterilized product is desired. Until such access is made, the aseptic nature of the contained product is preserved.

The system as shown in FIG. 13 illustrates one of the walls of the package, namely first wall 129.

Figure 14:
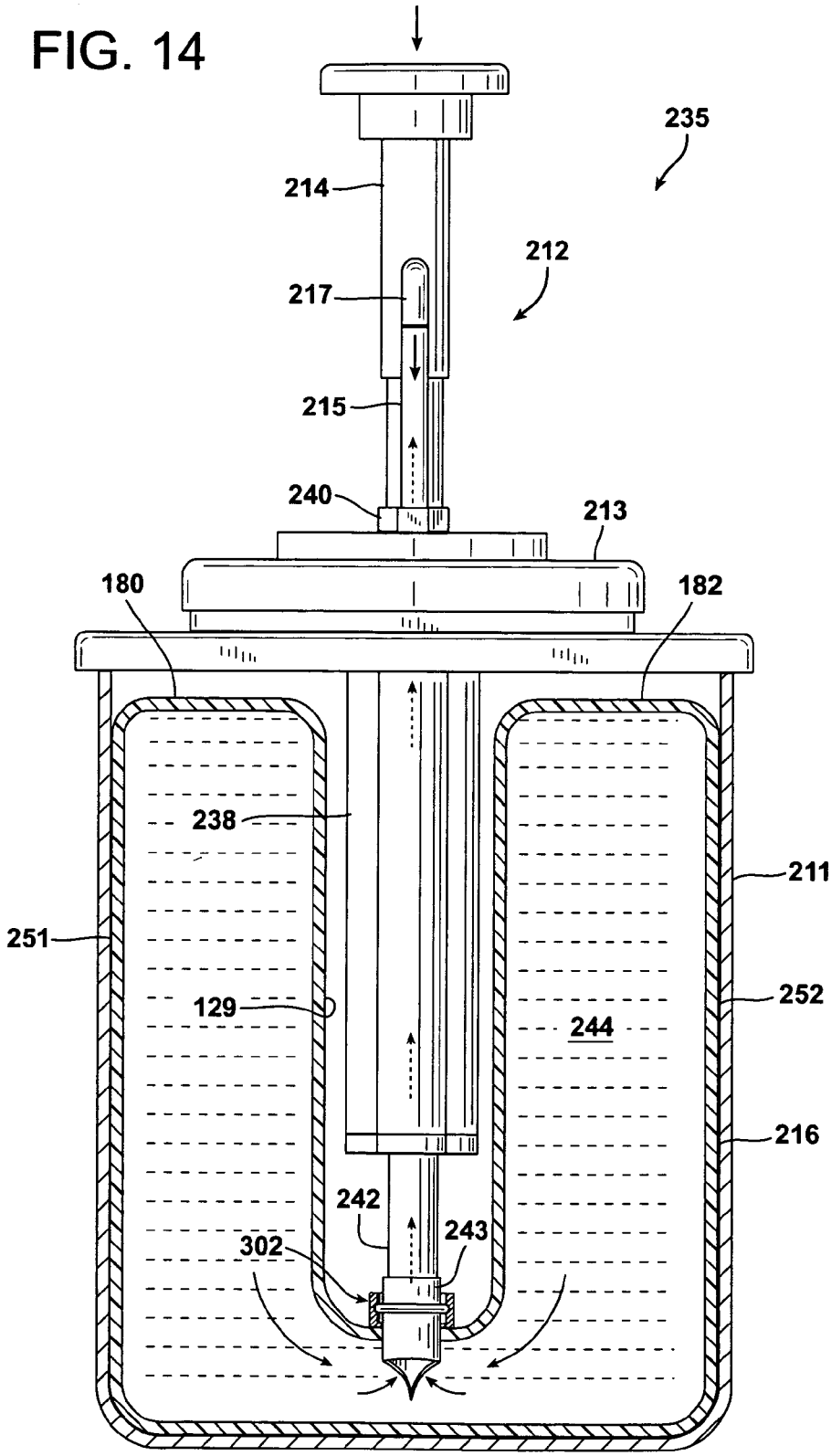
FIG. 14 is a front elevational view of the system of FIG. 13.

FIG. 14 shows a front elevational view of the system of FIG. 13,

No internal fitment, attached to an interior wall of the package in the vicinity of the external fitment, is required. Thus, in one embodiment the package of the invention is absent an internal fitment. In another embodiment, the package of the invention is absent an internal fitment in the vicinity of the external fitment.

The external fitment can have any suitable configuration. External fitments 302 can be completely attached to the film at any suitable point in the aseptic packaging system and process, or alternatively can be partially attached at any suitable point in the aseptic packaging system and process, and can then be completely attached after they have advanced with film 141 over forming tube 144, but before the longitudinal heat seal has been made in the VFFS process. The external fitments, if employed, are installed on the second surface of the film, i.e. the surface that will ultimately form the outside of the aseptic package. The sterilization of external fitments 302 is therefore optional in many applications. For example, the external fitments can be sealed to the second surface of the film upstream of the location in the system where the film is folded over the forming tube. For example, the external fitments can be installed on the second surface of the film after the film has been unwound from a roll of film, and before the sterilization step. Alternatively, external fitments 302 can be installed on the film as or after it is made into a package. Attachment of the external fitments 302 to the film or package can be done by any suitable attaching or sealing device such as that described herein. In one embodiment, the external fitments are each sealed to the second surface of the film by applying heat and pressure from a heat seal bar against the first surface of the film in the vicinity where each external fitment is to be attached to the film. Applying heat on the film side instead of on the fitment side is advantageous in more easily and securely attaching each fitment to the film.

Figure 15:
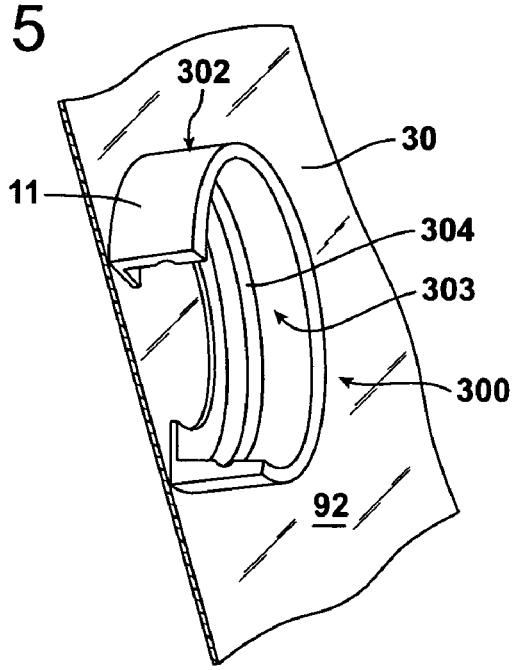
FIG. 15 is a perspective view of an external fitment attached to the film.
Figure 16:
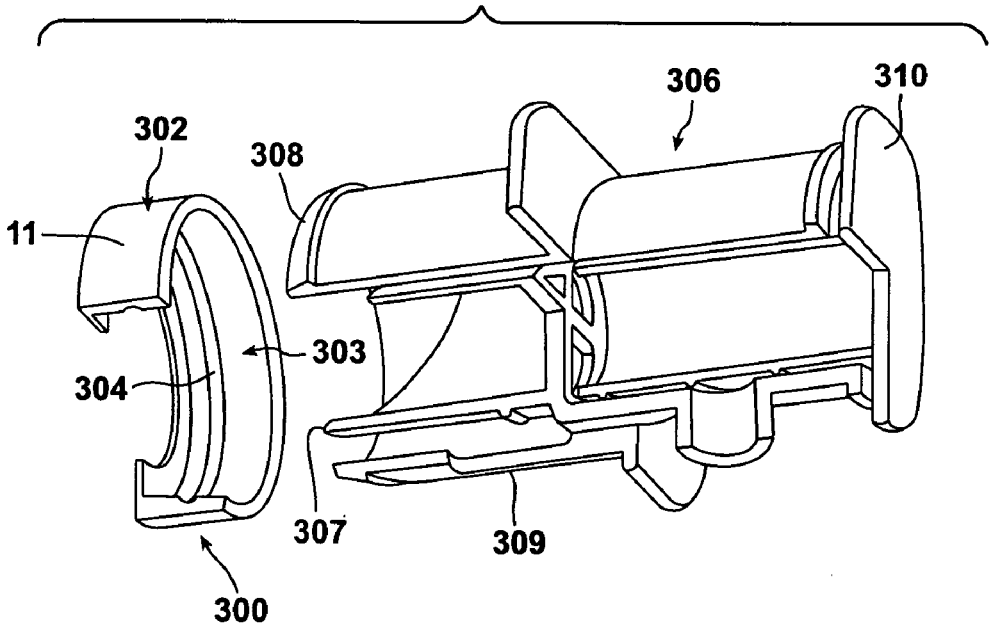
FIG. 16 is a perspective view of the fitment of FIG. 15, with an external tap.
Figure 17:
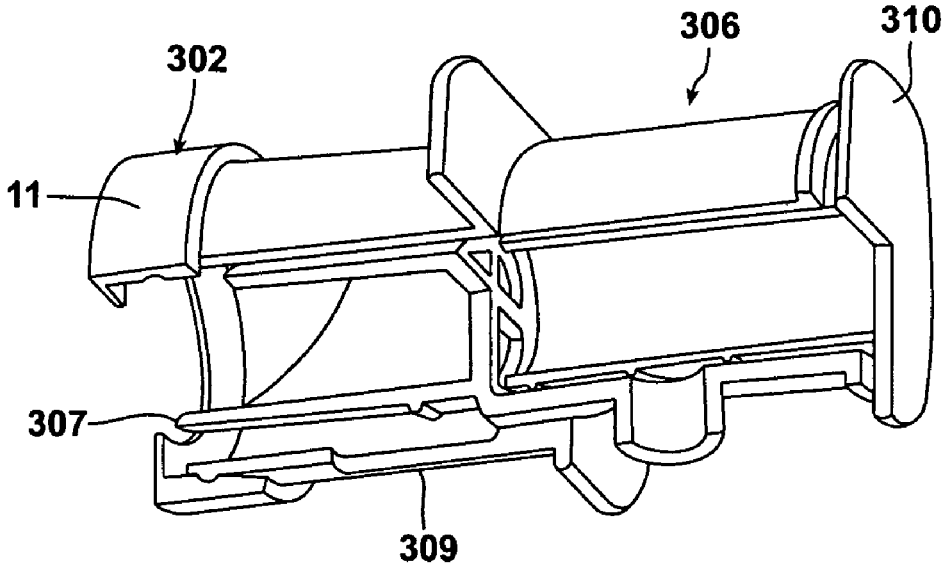
FIG. 17 is a perspective view of the fitment and tap of FIG. 16, with the external tap connected to the external fitment.
Figure 18:
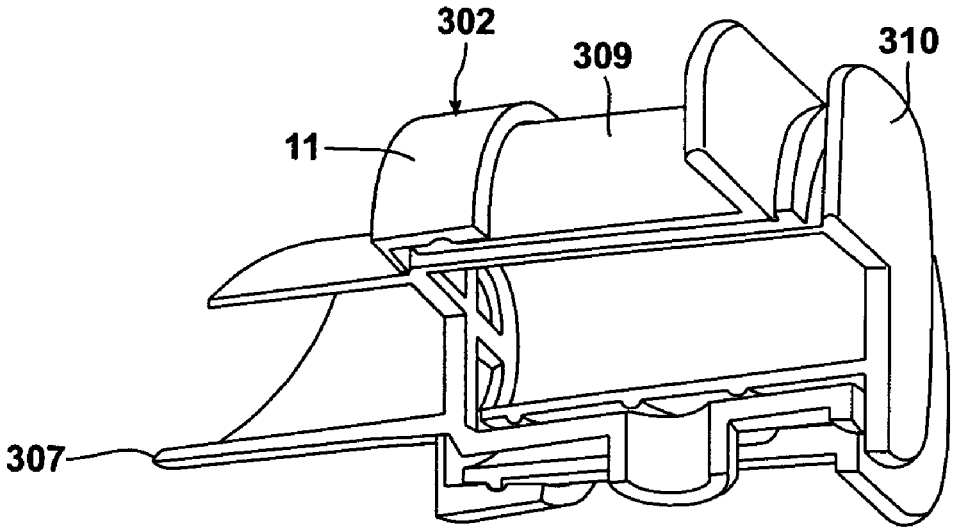
FIG. 18 is a perspective view of the fitment and tap of FIG. 17, with the piercing head of the external tap projecting through the external fitment and through the film (not shown)
Figure 19:
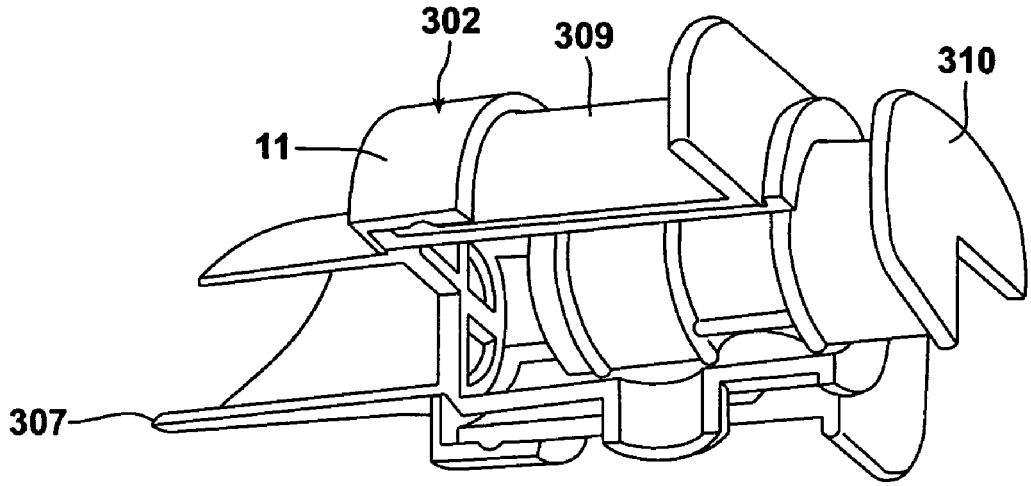
FIG. 19 is a perspective view of the fitment and tap of FIG. 18, with the external tap positioned to access the contents of an aseptic package.
Figure 20:
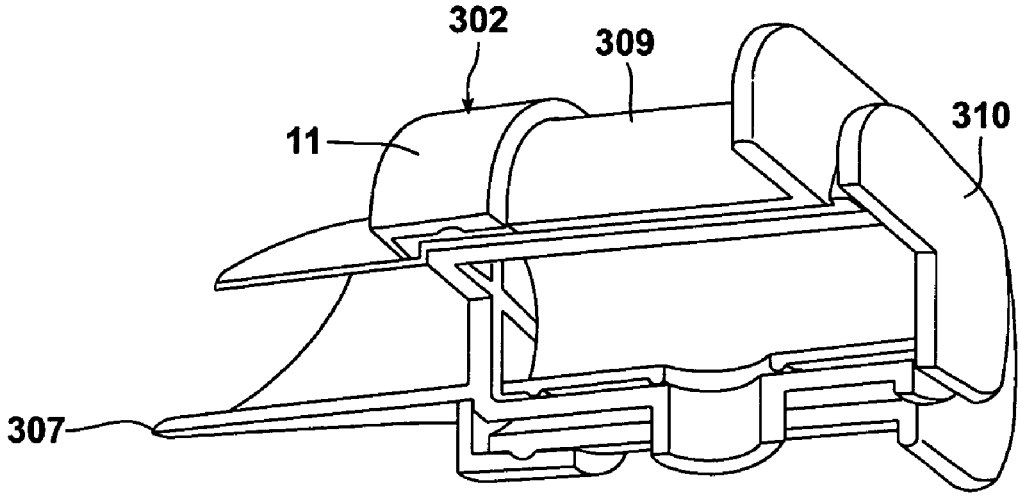
FIG. 20 is a perspective view of the fitment and tap of FIG. 19, with the external tap engaged to access the contents of an aseptic package.

In FIG. 15, a fitment system 300 includes an external fitment 302 attached to an exterior surface 92 of film 30 comprising a wall of the aseptic package. In one embodiment, external fitment 302 includes an annular depression 304 that provides for a mechanical interlock with a dispensing device 306 (see FIG. 16) having a ring 308 on one end thereof. Ring 308 is configured to mate with annular depression 304. Dispensing device 306 also includes a piercing nozzle 307, housing 309, and plunger 310. In operation, dispensing device 306 is mated with external fitment 302 by snapping ring 308 into annular depression 304 (FIG. 17). This step can be done at any time after manufacture of an aseptic package of the invention. When the end user desires to access the sterile product contained in the package, plunger 310, in a first orientation, is pushed toward the package to force the piercing nozzle 307 through orifice 303 of fitment 302 and through the package wall formed by film 30. The plunger 310 is then retracted, and is ready to dispense product. When subsequently rotated, and pushed toward the package (FIG. 20), product flows from the interior of the package, and is dispensed through dispensing device 306.

Many other suitable types and configurations of dispensing devices can be used in connection with the present invention, and can be adapted to connect to an external fitment by any suitable connection, such as that shown herein, or e.g. an interference fit or threaded connection. The dispensing device used can operate by vacuum or gravity feed.

The above descriptions are those of embodiments of the invention. All parts and percentages are by weight, unless otherwise indicated or well understood in the art. Except in the claims and the specific examples, or where otherwise expressly indicated, all numerical quantities in this description are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated.

Terms referring to polymers, such as polyester, polyamide, and polyolefin, refer herein to both homopolymers and copolymers thereof, unless otherwise specified.

With reference to the drawings, the flow of materials is in the direction of the arrows.

Those of skill in the art will recognize that the drawings herein are not necessarily to scale, and certain features of the invention may be graphically exaggerated for clarity.

The film used in the manufacture of the package according to the invention, can be made by any suitable process, including coextrusion, extrusion coating, extrusion lamination, and conventional lamination using polyurethane or other adhesives. These manufacturing processes are well known in the art. Extrusion can be done in annular or flat dies. The extrudate can be hot blown or cast, and optionally solid-state oriented as desired. Chemical or electronic crosslinking of one or more layers of the webs or the strip can be done. The film can be advanced through the system by suitable motive means (not shown, and well known in the art, such as a motor).

Fitments can be made by any suitable process, e.g. injection molding.

A package according to the invention can optionally carry printed indicia, which can be decorative or informational in nature. Decorative printed indicia can include a logo, a trademark, product information, etc. with text and/or graphics.

The system, process, and package disclosed herein are suitable for both high and low acid products and combinations thereof.

Those of skill in the art will recognize that the system and process described herein for advancing, sterilizing, and drying a second surface of a film, the second surface carrying a plurality of fitments, can be used simultaneously or sequentially to advance, sterilize, and dry a first surface of the film.

Film

Films for use in the present invention can comprise a thermoplastic material of any suitable composition, including those having as at least one component olefinic material such as ethylene polymer or copolymer, e.g. polyethylene or ethylene/alpha olefin copolymer; and/or polyamide (nylon); and including films typically used in VFFS and/or aseptic packaging apparatus and processes. The films can be monolayer or multilayer in construction, can be coextruded, laminated, or made by any suitable film making process, and can have any suitable thickness.

Examples of films useful in the invention include those with high oxygen barrier properties, and those with low oxygen barrier properties.

A representative multilayer film structure of some high oxygen barrier embodiments of the invention is shown in Table 1:

TABLE 1

| Material of layer G, or polyolefin | Tie | Nylon | EVOH | nylon | Tie | Amorphous material |
|---|---|---|---|---|---|---|
| A | B | C | D | E | F | G |

Core layer D of the above film structure can comprise any suitable EVOH material, and can be blended in any proportion with other polymeric materials or organic or inorganic additives as desired.

Intermediate layers C and E each comprise a polyamide, such as a semicrystalline polyamide such as nylon 6. In one embodiment, layers C and E can each comprise a blend of an amorphous polyamide and a semicrystalline polyamide. In such an embodiment, the amorphous polyamide can comprise any suitable percent of the overall polyamide blend.

The semicrystalline polyamide can be any suitable polyamide, including nylon 6.

Tie layers B and F can comprise any suitable polymeric adhesive that functions to bond two layers together. Materials that can be used in embodiments of the present invention include anhydride grafted ethylene/alpha olefin copolymer.

Layer A will typically function as a sealant layer of the film. This layer can comprise one or more semicrystalline olefinic polymers. Polymers that may be used for the layer A include ethylene polymer or copolymer, ethylene/alpha olefin copolymer, ethylene/vinyl acetate copolymer, ionomer resin, ethylene/acrylic or methacrylic acid copolymer, ethylene/acrylate or methacrylate copolymer, etc., or blends of any of these materials.

Alternatively, layer A can comprise a material as defined herein for layer G.

Layer G comprises one or more semicrystalline olefinic polymers, and/or an amorphous polymer e.g. amorphous cyclic olefin copolymer, e.g. ethylene/norbornene copolymer (ENB). In one embodiment, layer G can comprise one outermost layer of the film such that when formed into a pouch, layer G comprises the layer furthest from the packaged product; and an olefinic polymer or copolymer such as ethylene/alpha olefin copolymer (EAO) can comprise the inner layer A of the film, such that when formed into a pouch, the EAO comprises the layer closest to the packaged product. In this embodiment, the film can be lap sealed, for example a longitudinal lap seal running the length of the pouch, such that layer G is sealed to the EAO inner layer A. This embodiment provides a longitudinally lap sealed pouch.

A representative multilayer film structure of some low oxygen barrier embodiments of the invention is shown in Table 2:

TABLE 2

| Material of layer G, or polyolefin | Tie | Nylon | Tie | nylon | Tie | Amorphous material |
|---|---|---|---|---|---|---|
| A | B | C | D | E | F | G |

The materials for film structures in accordance with table 2 can be as disclosed herein for table 1.

Pouches made from the film of the present invention can be fin sealed or lap sealed (typically referring to the longitudinal seal running the length of the pouch) depending on the desired configuration of the finished pouch, the equipment used, and the composition of the two outer layers.

Additional materials that can be incorporated into one or both of the outer layers of the film, and in other layers of the film as appropriate, include antiblock agents, slip agents, antifog agents, fillers, pigments, dyestuffs, antioxidants, stabilizers, processing aids, plasticizers, fire retardants, UV absorbers, etc. Additional film layers can be included either within the film structure, or adhered to an outer layer thereof.

In general, the film can have any total thickness desired, and each layer can have any thickness desired, so long as the film provides the desired properties for the particular packaging operation in which the film is used. Typical total thicknesses are from 0.5 mils to 15 mils, such as 1 mil to 12 mils, such as 2 mils to 10 mils, 3 mils to 8 mils, and 4 mils to 6 mils.

Film Examples 1 and 2

Two film structures for use in connection with making pouches in accordance with the invention are identified below. Film Example 1 represents a high oxygen barrier film; Film Example 2 represents a low oxygen barrier film. Materials used are as shown in Table 3.

TABLE 3

Resin Identification

| Material Code | Tradename Or Designation | Source(s) |
|---|---|---|
| AB1 | 502835 ™ | Ampacet |
| PE1 | ELITE ™ 5400 G | Dow |
| PE2 | DOW ™ 2045.04 | Dow |
| PE3 | 662I ™ | Dow |
| PE4 | T50-200-178 ™ | Ineos |
| AD1 | PLEXAR ™ PX3236 ™ | LyondellBasell Industries |
| AD2 | PX3410 ™ | LyondellBasell Industries |
| PA1 | ULTRAMID ™ B40LN01 | BASF |
| OB1 | EVAL ™ L171B | Evalca |
| EN1 | TOPAS 8007 F-04 ™ | Topas Advanced Polymers, Inc. |

AB1 is a masterbatch having about 80%, by weight of the masterbatch, of FORTIFLEX ™ T60-500-119, a high density polyethylene with a density of 0.961 grams/cc; about 16%, by weight of the masterbatch, of SILTON JC30A ™, a sodium calcium aluminum silicate, $NaCaAl(Si_2O_7)$; and about 4 w %, by weight of the masterbatch, of CLEAR Block80 ™ talc, an antiblocking agent.

PE1 is an IPN resin with a density of 0.917 grams/cc, and a melt flow index of 1.0.

PE2 is an ethylene/octene-1 copolymer with a 6.5 weight % octene content, and a density of 0.920 grams/cc.

PE3 is a low density polyethylene resin.

PE4 is an ethylene/1-butene copolymer resin with a density of 0.952 grams/cc.

AD1 is a maleic anhydride-modified linear low density polyethylene with a density of 0.921 grams/cc.

AD2 is a maleic anhydride-modified linear low density polyethylene.

PA1 is a nylon 6 (poly(caprolactam)).

OB1 is an ethylene/vinyl alcohol copolymer with less than 30 mole % ethylene.

EN1 is an ethylene/norbornene copolymer with a norbornene content of 36 mole % of the copolymer and a Tg of 80° C.

All compositional percentages given herein are by weight, unless indicated otherwise.

The following films were made by otherwise conventional coextrusion techniques.

TABLE 4

Film structures

| | Layers | | | | | | |
|---|---|---|---|---|---|---|---|
| Example | A | B | C | D | E | F | G |
| Ex. 1 | 8% AB1 + 22% PE3 + 70% PE2 | AD2 | PA1 | OB1 | PA1 | AD2 | 60% EN1 + 15% PE4 + 20% PE1 + 5% AB1 |

TABLE 4-continued

Film structures

| | Layers | | | | | | |
|---|---|---|---|---|---|---|---|
| Example | A | B | C | D | E | F | G |
| Mils | 1.93 | 0.28 | 0.55 | 0.55 | 0.55 | 1.10 | 0.55 |
| Vol % | 35.0 | 5.0 | 10.0 | 10.0 | 10.0 | 20.0 | 10.0 |
| Ex. 2 | 8% AB1 + 22% PE3 + 70% PE2 | AD1 | PA1 | AD1 | PA1 | 70% AD1 + 30% PE2 | 60% EN1 + 15% PE4 + 20% PE1 + 5% AB1 |
| Mils | 1.93 | 0.28 | 0.55 | 0.55 | 0.55 | 1.10 | 0.55 |
| Vol % | 35.0 | 5.0 | 10.0 | 10.0 | 10.0 | 20.0 | 10.0 |

Example 1 is a commercial product of the Cryovac business unit of Sealed Air Corporation.

Other films suitable for use in various embodiments of the invention are disclosed in U.S. Pat. No. 6,780,373 (Musco), US Patent Publication Nos. 2006/0228502 A1 (Bekele), 2007/0110853 A1 (Bekele), and 2009-0123611-A1 (Bekele), and copending U.S. Patent application Ser. No. 61/271,906, filed Jul. 28, 2009, entitled "Ultra High Barrier Aseptic Film And Package", all incorporated herein by reference in their entirety.

What is claimed is:

1. A method of making an aseptic package in a vertical/fill/seal process comprising:

a) providing a lay-flat film on a first roll of film, the lay-flat film comprising a first and second surface;

b) providing a plurality of fitments;

c) unwinding the film from the first roll of film;

d) advancing the lay-flat film to an apparatus for attaching each of the plurality of fitments to the film;

e) feeding each of the plurality of fitments from a fitment feed device to the apparatus for attaching each of the plurality of fitments to the film;

f) attaching each of the plurality of fitments to the second surface of the film;

g) advancing the film, with the plurality of fitments attached to the second surface thereof, to an assembly for sterilizing the film and each of the plurality of fitments;

h) sterilizing the film and each of the plurality of fitments;

i) advancing the sterilized film, with the plurality of sterilized fitments attached to the second surface thereof, to an assembly for drying the film and each of the plurality of fitments;

j) drying the film and each of the plurality of fitments;

k) advancing the sterilized film, with the plurality of sterilized fitments attached to the second surface thereof, to a vertical form/fill seal apparatus for making a plurality of packages from the sterilized film and each of the plurality of sterilized fitments;

l) advancing the sterilized film over a forming device to convert the lay-flat film to a folded film having a sterilized interior surface;

m) advancing each of the plurality of sterilized fitments with the film such that when the package is made, a fitment is disposed on an exterior surface of each package;

n) making a longitudinal seal in the folded film;

o) transversely sealing the folded film to produce a first transverse seal to define a first pouch, wherein the first transverse seal is a bottom transverse seal of the first pouch;

p) putting a sterilized product in the first pouch;

q) advancing the folded film, with the first pouch, downward a predetermined distance;

r) transversely sealing the first pouch to produce a top transverse seal in the first pouch, and a bottom transverse seal in a second pouch, the second pouch disposed above the first pouch; and s) transversely cutting the folded film to separate the first pouch from the second pouch to make a package, the package comprising i) a pouch comprising (a) a first transverse seal at a first end of the pouch, (b) a second transverse seal at a second end of the pouch, (c) a first fold at a first side of the pouch, (d) a second fold at a second side of the pouch, (e) a sterilized interior surface, (f) the exterior surface, (g) a longitudinal seal extending from the first end of the pouch to the second end of the pouch; and (h) an external fitment sealed to the exterior surface of the pouch; and ii) a sterilized product disposed in the pouch.

2. The method of claim 1 comprising, in step f), partially attaching each of the plurality of fitments to the second surface of the film; and any time after step f) and before step n), completing the attachment of each of the plurality of fitments to the film.

3. An aseptic packaging system comprising:

a) a film unwind device for unwinding a film from a first roll of film;

b) a external fitment feed device for feeding a plurality of fitments;

c) an apparatus for attaching each of the plurality of fitments to the film;

d) an assembly for sterilizing the film and each of the plurality of fitments;

e) an assembly for drying the film and each of the plurality of fitments, wherein the assembly for drying the film and each of the plurality of fitments comprises a fixed mandrel, disposed opposite each fitment, adapted to deflect the film as each fitment advances through the drying chamber, resulting in diversion of the film away from unattached portions of each fitment to facilitate drying of each fitment; and f) a vertical form/fill seal apparatus for making a plurality of packages from the sterilized film and each of the plurality of sterilized fitments, each package comprising i) a pouch comprising (a) a first transverse seal at a first end of the pouch, (b) a second transverse seal at a second end of the pouch, (c) a first fold at a first side of the pouch, (d) a second fold at a second side of the pouch, (e) an interior surface, (f) an exterior surface, (g) a longitudinal seal extending from the first end of the pouch to the second end of the pouch; and (h) an external fitment sealed to the exterior surface of the pouch; and ii) a sterilized product disposed in the pouch.

4. The system of claim 3 wherein the system comprises a second roll of film, a second end of the first roll of film capable of being spliced to a first end of the second roll of film.

5. The system of claim 3 wherein the fitment feed device for feeding a plurality of fitments comprises an orienter for aligning the plurality of fitments in a pre-determined direction, and a guiding device for guiding each of the plurality of fitments to the apparatus for attaching each of the plurality of fitments to the film.

6. The system of claim 3 wherein the fitment feed device for feeding a plurality of fitments comprises an orienter for aligning the plurality of fitments in a pre-determined direction, and a guiding device for guiding each of the plurality of fitments to the apparatus for attaching each of the plurality of fitments to the film in sequential fashion.

7. The system of claim 3 wherein each of the plurality of fitments comprises an annular ring, and a central orifice.

8. The system of claim 3 wherein each of the plurality of fitments comprises an annular ring, a central orifice, and an annular depression disposed on the inner surface of the annular ring.

9. The system of claim 3 wherein the apparatus for attaching each of the plurality of fitments to the film comprises an apparatus for partially attaching each of the plurality of fitments to the film, and the vertical form/fill/seal apparatus comprises a device for completing the attachment of each of the plurality of fitments to the film.

10. The system of claim 9 wherein the apparatus for partially attaching each of the plurality of fitments to the film comprises a sealing assembly wherein a seal bar seals the film to only a portion of the fitment at two regions on the fitment, the two regions spaced apart from one another.

11. The system of claim 9 wherein the apparatus for partially attaching each of the plurality of fitments to the film comprises a sealing system wherein each of the plurality of fitments comprises an annular ring, and a central orifice, and a seal bar seals the film to only a portion of the annular ring, at two regions on the annular ring, the two regions spaced apart from one another.

12. The system of claim 9 wherein the apparatus for partially attaching each of the plurality of fitments to the film comprises a sealing system wherein each of the plurality of fitments comprises an annular ring, and a central orifice, and a seal bar seals the film to only a portion of the annular ring, at two regions on the annular ring, the two regions spaced apart from one another by about 180°.

13. The system of claim 3 wherein the assembly for sterilizing the film and each of the plurality of fitments comprises a hydrogen peroxide bath.

14. The system of claim 3 wherein the assembly for drying the film and each of the plurality of fitments comprises a drying chamber, wherein the drying chamber comprises a tubular device for projecting sterile air onto each of the plurality of fitments as each fitment advances through the drying chamber.

15. The system of claim 9 wherein the device for completing the attachment of each of the plurality of fitments to the film comprises a sealing assembly wherein a seal bar completes the attachment of each of the partially attached plurality of fitments to the second surface of the film.

* * * * *